US009433286B2

(12) United States Patent
Kane et al.

(10) Patent No.: US 9,433,286 B2
(45) Date of Patent: Sep. 6, 2016

(54) CABINETRY SYSTEM HAVING REMOVABLE CABINET FACES

(71) Applicant: Richardson Industries, Inc., Sheboygan Falls, WI (US)

(72) Inventors: Gary R. Kane, Sheboygan Falls, WI (US); Adam J. Schneider, Howards Grove, WI (US); Jason T. Gudex, Howards Grove, WI (US); James A. Voigt, Glenbeulah, WI (US); Steven M. Dassow, Plymouth, WI (US)

(73) Assignee: Richardson Industries, Inc., Sheboygan Falls, WI (US)

( * ) Notice: Subject to any disclaimer, the term of this patent is extended or adjusted under 35 U.S.C. 154(b) by 0 days.

(21) Appl. No.: 14/939,302

(22) Filed: Nov. 12, 2015

(65) Prior Publication Data

US 2016/0058180 A1 Mar. 3, 2016

Related U.S. Application Data

(63) Continuation of application No. 14/639,438, filed on Mar. 5, 2015, now Pat. No. 9,185,981, which is a continuation-in-part of application No. 14/467,228, filed on Aug. 25, 2014, now Pat. No. 9,125,492.

(51) Int. Cl.

| | |
|---|---|
| ***A47B 49/00*** | (2006.01) |
| ***A47B 77/02*** | (2006.01) |
| ***A47B 47/05*** | (2006.01) |
| ***A47B 88/00*** | (2006.01) |
| ***A47B 95/04*** | (2006.01) |

(Continued)

(52) U.S. Cl.

CPC ..... *A47B 77/02* (2013.01); *A47B 47/05* (2013.01); *A47B 77/04* (2013.01); *A47B 88/0044* (2013.01); *A47B 95/00* (2013.01); *A47B 95/04* (2013.01); *A47B 96/00* (2013.01); *A47B 96/201* (2013.01); *A47B 2096/207* (2013.01); *A47B 2096/209* (2013.01)

(58) Field of Classification Search

CPC ... E05Y 2900/20; E06B 3/52; E06B 3/5045; E06B 2003/703; E06B 2003/7046; E06B 2003/7013; A47B 2096/209; A47B 2096/207; A47B 77/02; A47B 77/04; A47B 47/05; A47B 88/0044; A47B 95/00; A47B 95/04; A47B 96/00; A47B 96/201; F25D 23/02; F25D 23/028; Y10T 24/45099; Y10T 24/45257; Y10T 24/45602; Y10S 160/16

See application file for complete search history.

(56) References Cited

U.S. PATENT DOCUMENTS 3,109,685 A * 11/1963 Skorupa ..... A47B 63/02 312/204
3,338,649 A * 8/1967 Stewart ..... A47B 95/02 312/204

(Continued)

*Primary Examiner* — Hanh V Tran
(74) *Attorney, Agent, or Firm* — Ziolkowski Patent Solutions Group, SC

(57) ABSTRACT

A door assembly is disclosed herein that is usable in a cabinetry system having removable cabinet faces. The door assembly includes a door plate coupleable to at least one hinge assembly, the door plate having a first portion and a second portion extending outward from the first portion. The door assembly also includes a door panel having a recess formed in an inward-facing surface thereof, the recess sized to receive the door plate. A plurality of magnets are inset within the inward-facing surface of the door panel adjacent the recess and are magnetically coupled to the door plate. According to various embodiments, the door plate may have a substantially L-shaped or C-shaped configuration.

20 Claims, 24 Drawing Sheets

(51) Int. Cl.

| | |
|---|---|
| ***A47B 96/00*** | (2006.01) |
| ***A47B 77/04*** | (2006.01) |
| ***A47B 95/00*** | (2006.01) |
| *A47B 96/20* | (2006.01) |

(56) References Cited

U.S. PATENT DOCUMENTS

| | | | | | |
|---|---|---|---|---|---|
| 3,533,190 | A * | 10/1970 | Johnson | E06B 3/9641 | 49/402 |
| 3,666,341 | A * | 5/1972 | Little | A47B 88/0044 | 312/189 |
| 3,697,363 | A * | 10/1972 | Martinez | A47B 95/00 | 312/204 |
| 3,738,726 | A * | 6/1973 | Burst | A47B 47/05 | 312/204 |
| 3,826,551 | A * | 7/1974 | Schwartz | A47B 96/201 | 312/140 |
| 4,118,543 | A * | 10/1978 | Donohue | E06B 3/7017 | 428/615 |
| 4,304,447 | A | 12/1981 | Ellwood et al. | | |
| 4,725,107 | A * | 2/1988 | Appleton | F25D 11/02 | 312/116 |
| 4,949,520 | A * | 8/1990 | Bear | E04F 19/0436 | 312/204 |
| 5,176,435 | A * | 1/1993 | Pipkens | A47B 17/00 | 312/204 |
| 5,280,991 | A | 1/1994 | Weiland | | |
| 5,644,870 | A * | 7/1997 | Chen | E06B 3/7001 | 49/501 |
| 5,791,752 | A * | 8/1998 | Hartman | E06B 5/006 | 312/204 |
| 6,073,675 | A | 6/2000 | Dannaher | | |
| 7,014,281 | B2 * | 3/2006 | Wuestefeld | A47L 15/4265 | 126/194 |
| 8,870,306 | B2 | 10/2014 | Simon | | |
| 2003/0091784 | A1 | 5/2003 | Nykamp et al. | | |
| 2003/0170594 | A1 | 9/2003 | Anderson et al. | | |
| 2003/0222547 | A1 | 12/2003 | Trees | | |
| 2005/0225216 | A1 * | 10/2005 | Kim | A47B 96/201 | 312/204 |
| 2007/0018541 | A1 * | 1/2007 | Hacker | E05G 1/00 | 312/204 |
| 2008/0042531 | A1 * | 2/2008 | Livingston | A47B 47/0091 | 312/204 |
| 2009/0199375 | A1 * | 8/2009 | Koelling | A43C 15/161 | 24/700 |
| 2011/0089790 | A1 * | 4/2011 | Lee | B29C 44/1233 | 312/109 |
| 2011/0204757 | A1 | 8/2011 | Komata et al. | | |
| 2012/0169192 | A1 * | 7/2012 | Simon | A47B 95/00 | 312/228 |
| 2013/0099644 | A1 | 4/2013 | Takeuchi et al. | | |

* cited by examiner

CABINETRY SYSTEM HAVING REMOVABLE CABINET FACES

CROSS REFERENCE TO RELATED APPLICATION

The present application is a continuation of, and claims priority to, U.S. Non-Provisional application Ser. No. 14/639,438, filed Mar. 5, 2015, which is a continuation-in-part application of U.S. Non-Provisional application Ser. No. 14/467,228, filed Aug. 25, 2014, now U.S. Pat. No. 9,125,492, the disclosures of which are incorporated herein by reference in their entirety.

BACKGROUND OF THE INVENTION

Embodiments of the invention relate generally to residential and commercial cabinetry, and, more particularly, to a cabinetry system wherein the exterior surface elements or face panels of the cabinets are removably coupled to the internal bodies or frames of the cabinets in a manner that facilitates quickly changing the appearance of the cabinetry system.

Replacing cabinetry accounts for a large percentage of the cost of a room renovation. In the case of a kitchen, for example, kitchen cabinets may account for fifty percent or more of the entire cost of the renovation. A large portion of the costs of a cabinet is accounted for in the cabinet's interior body or box, which constitutes the bulk of the material of the cabinet and is costly to ship due to its size and weight.

Therefore, it would be desirable to design a cabinetry system that includes cabinet faces that can be easily removed from the base structure of the cabinetry system and interchanged with other sets of cabinet faces to quickly and easily change the appearance of the cabinets without replacing the costly interior structure of the cabinets.

BRIEF DESCRIPTION OF THE INVENTION

In accordance with one aspect of the invention, a door assembly includes a door plate coupleable to at least one hinge assembly, the door plate having a first portion and a second portion extending outward from the first portion. The door assembly also includes a door panel having a recess formed in an inward-facing surface thereof, the recess sized to receive the door plate and a plurality of magnets inset within the inward-facing surface of the door panel adjacent the recess, the plurality of magnets magnetically coupled to the door plate.

In accordance with another aspect of the invention, a cabinet assembly includes a cabinet box comprising a pair of side panels and a door assembly. The door assembly includes a hinge assembly and a door plate coupled to a side panel of the pair of side panels via the hinge assembly, the door plate comprising a vertical portion and at least one horizontal portion extending outwardly from the vertical portion. The door assembly also includes a door panel having a recess formed in an inward-facing surface thereof and a first plurality of magnets positioned within recesses formed within the inward-facing surface of the door panel adjacent the recess. The first plurality of magnets are magnetically coupled to the door plate.

In accordance with a further aspect of the invention, a door assembly includes at least one hinge, an L-shaped magnetic plate coupled to the at least one hinge via a mechanical fastener, and a door panel coupled to the L-shaped magnetic plate via a plurality of magnets, the door panel having an L-shaped recess sized to receive the L-shaped magnetic plate. A surface of the door panel and a surface of the L-shaped magnetic plate form an interior surface of the door assembly.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Embodiments of the invention are directed to a cabinetry system that includes removable face panels, which permit the entire outward appearance of the cabinetry system to be changed within a short period of time. The removable face panels, which include door panels, drawer panels, end panels, and trim components, are coupled to the cabinet boxes and interior frame structure of the cabinetry system using a magnetic attachment system, which functions to consistently self-align these panels and trim components with the internal cabinet structure and enables removal of the panels and trim components with no (or minimal) tools. After being removed from the cabinets, one set of door and drawer panels may be stored in internal storage components provided within the cabinetry system while a second set of door and drawer panels are in use.

Such a system enables a homeowner to have a perceived 'new' kitchen with minimal time and effort. The homeowner may purchase different sets of removable face panels, each having its own style and/or color, and change the façade of their kitchen as often as they desire. For example, a homeowner may purchase different sets of door and drawer panels for seasonal use, or may purchase a different set of door based on changing tastes or design trends.

While the cabinetry system is described herein in the context of a residential kitchen cabinetry system, it is contemplated that the concepts disclosed herein may be extended to other cabinet applications, including residential bathroom and utility cabinets as well as cabinetry systems used in commercial office settings and hotel rooms, as non-limiting examples.

Figure 1:
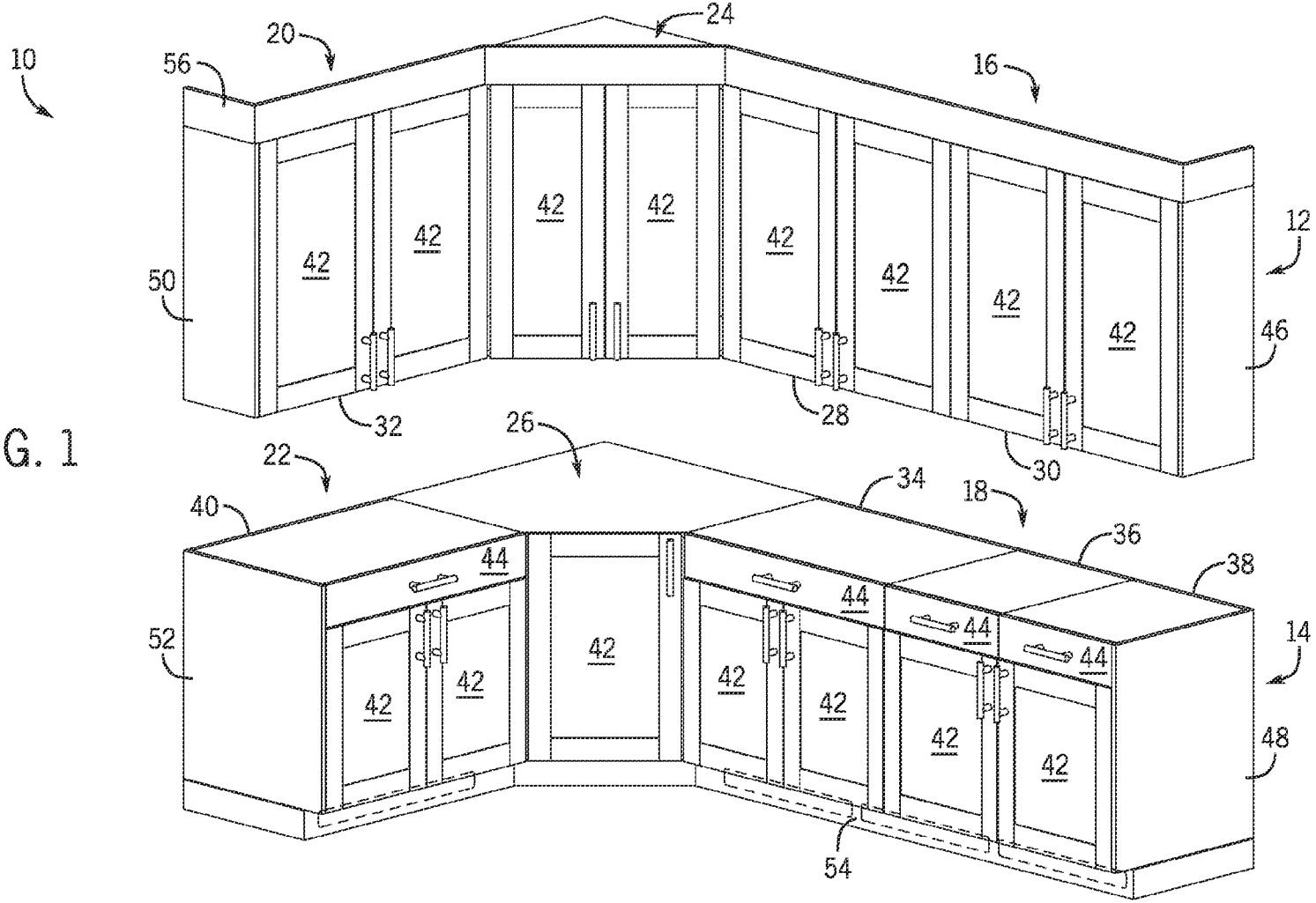
FIG. 1 is a perspective view of cabinetry system according to an embodiment of the invention.

FIG. 1 illustrates a cabinetry system 10 according to one embodiment of the invention. As shown, cabinetry system 10 includes an assembly of upper cabinets 12 and an assembly of lower cabinets 14. In the illustrated embodiment, upper and lower cabinet assemblies 12, 14 each include a first portion 16, 18 and a second portion 20, 22 joined to one another by a respective corner cabinet 24, 26. The first portion 16 of upper cabinet assembly 12 includes upper cabinets 28, 30 and the second portion 20 includes upper cabinet upper cabinet 32. First portion 18 of lower cabinet assembly 14 includes base cabinets 34, 36, 38, and second portion 22 includes base cabinet 40.

While cabinetry system 10 is illustrated in an L-shaped configuration, one skilled in the art will recognize that the concepts set forth herein are not limited to any particular arrangement of cabinets and may be adapted to cabinetry systems having more or less individual cabinets than that shown in FIG. 1. For example, alternative cabinetry system configurations may include, as non-limiting examples, U-shaped, galley, or single wall configurations, and cabinetry systems including only upper cabinets or only lower cabinets. Further, it is contemplated that the concepts set forth herein may be extended to wall-mounted and floor-mounted cabinetry as well as free-standing cabinetry systems including one or more individual cabinet sections.

Cabinets 24-40 are provided having door panels 42 and drawer panels 44 that are mounted in a full overlay configuration, as shown in FIG. 1. As used herein, the term "full overlay" refers to a frameless or Euro-style cabinet configuration wherein the door panels and drawer panels overlay substantially all of the front-facing surfaces of the interior cabinet boxes or internal structural frames of the cabinets when the doors and drawers are in a closed position. A minimal gap exists between adjacent the side surfaces of each door and drawer panel such that the front-facing surfaces of the interior cabinet boxes are not visible behind the door and drawer panels.

While the upper cabinets 24, 28, 30, and 32 are illustrated as each having a pair of door panels 42, it is further contemplated that any or all of cabinets 24-30 may be configured with a single door panel 42. Similarly, concepts disclosed herein may be extended to base cabinets 26, 34, 36, 38, 40 having alternative configurations than those illustrated in FIG. 1, such as, for example, single door cabinets, cabinets having multiple drawer panels 44, and cabinets having one or multiple door panels 42 without any drawer panels 44.

Cabinetry system 10 also includes end panels 46, 48, 50, 52 that are coupled to the outward-facing end surfaces of the respective first portions 16, 18 and second portions 20, 22 of upper and lower cabinet assemblies 12, 14. Lower cabinet assembly 14 is mounted atop a toe kick assembly 54, which may be constructed to include storage compartments for door and drawer panels, as described in detail below. Optionally, a crown molding assembly 56 is provided above upper cabinet assembly 12.

Figure 2:
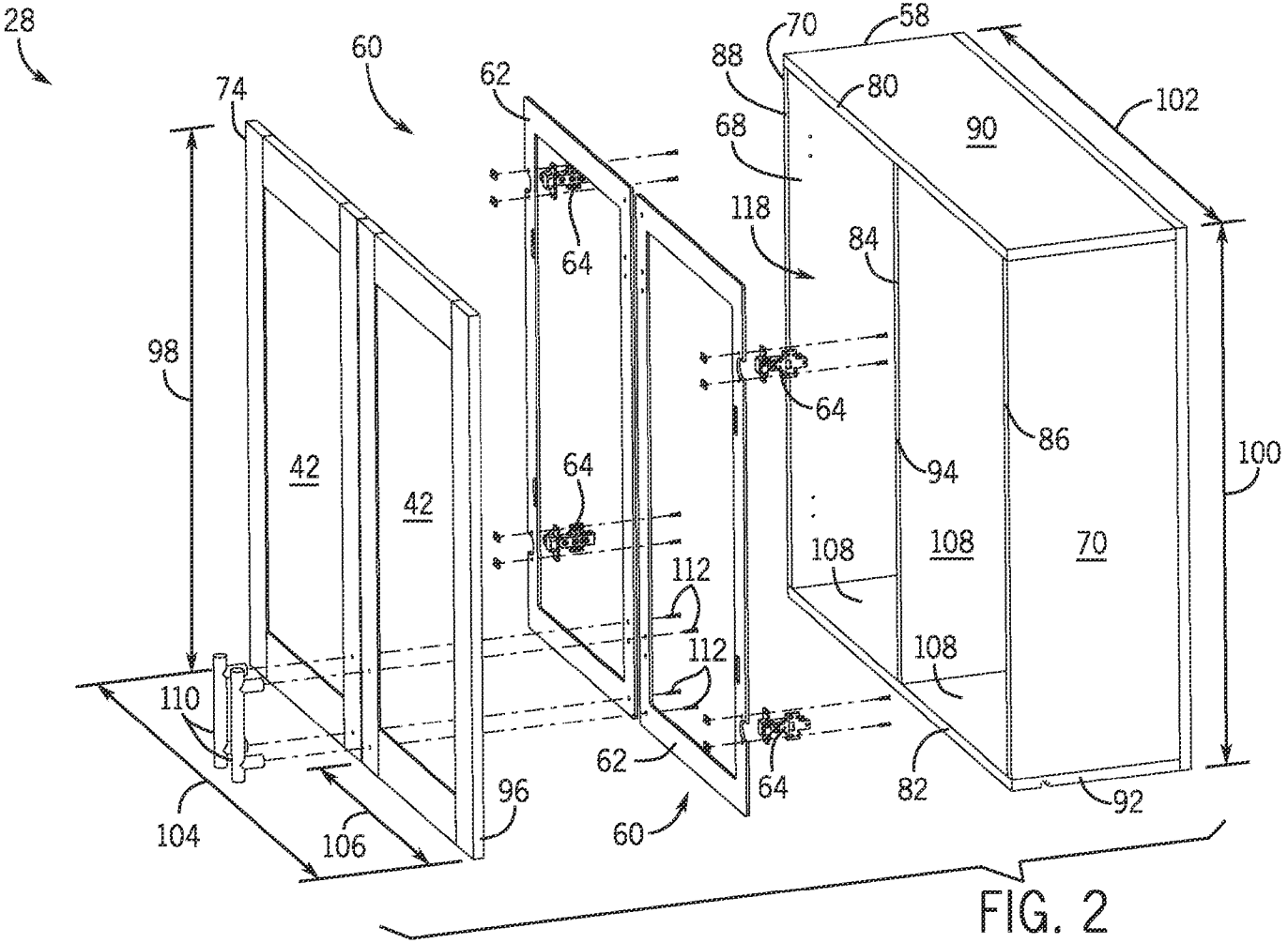
FIG. 2 is an exploded perspective view of a cabinet assembly useable with the cabinetry system of FIG. 1, according to an embodiment of the invention.

Referring now to FIG. 2, an exploded view of upper cabinet 28 is provided to illustrate the interrelationship of the structural elements provided within an upper cabinet of cabinetry system 10. As shown, upper cabinet 28 includes a cabinet box or structural frame 58 and a pair of door assemblies 60. Each door assembly 60 includes a door panel 42, a metal door plate 62, and a pair of hinge assemblies 64. In one embodiment, cabinet box 58 is constructed of a cost-effective material such as, for example, a melamine substrate, particle board, or a medium-density fibreboard (MDF) core material. While upper cabinet 28 is illustrated having two door assemblies 60, it is contemplated that the cabinet construction may be extended to single door cabinets.

Figure 3:
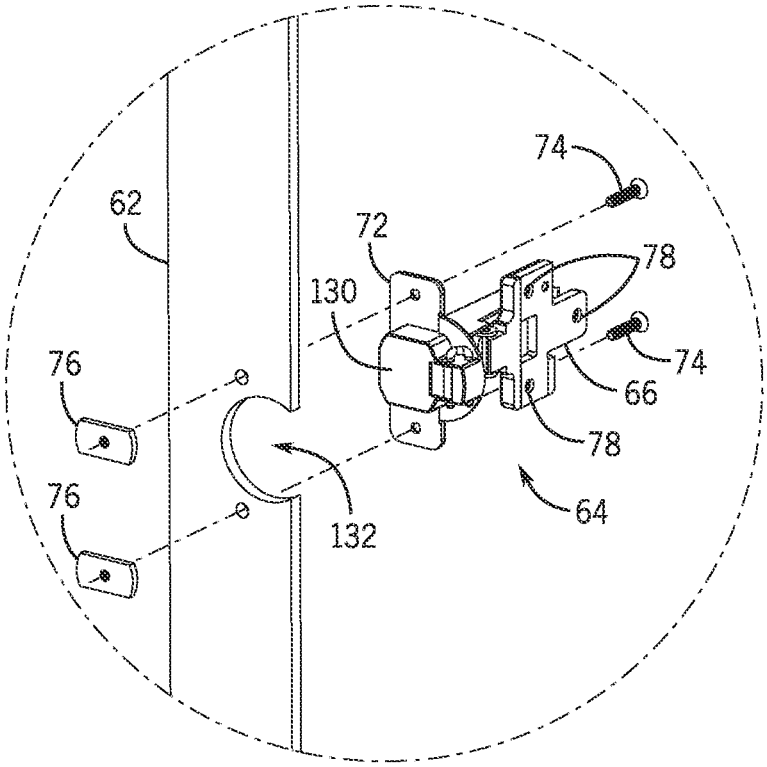
FIG. 3 is a detail view of a hinge assembly included within the cabinet assembly of FIG. 2.

Each hinge assembly 64 comprises a first hinge portion 66 that is fixedly coupled to an interior surface 68 of a respective side panel 70 of cabinet box 58 and a second hinge portion 72 that is fixedly coupled to metal door plate 62, as shown in the detailed view of FIG. 3. Threaded hinge fasteners 74 and corresponding hinge nuts 76 couple hinge assembly 64 to metal door plate 62. Hinge assembly 64 is coupled to the interior of cabinet box 58 using threaded fasteners (not shown), which extend through openings 78 of first hinge portion 66 and engage side panels 70.

In a preferred embodiment hinge assemblies 64 are full overlay-style cabinet hinges, which permit door panels 42 to completely overlay or cover the front-facing surfaces 80, 82, 84, 86, 88 of the top panel 90, bottom panel 92, two side panels 70, and central panel 94 of cabinet box 58 when the door assemblies 60 are in a closed position. Hinge assemblies 64 allow the end surface 96 of door panel 42 to swing and rotate outwardly as the door panel 42 is opened such that the end surface 96 of the door panel 42 is substantially perpendicular to the front-facing side surface 86 of cabinet box 58 when door panel 42 is in a fully opened position. In a preferred embodiment, hinge assemblies 64 are slow-closing or soft-closing hinges such as, for example, slow closing, full overlay style hinges manufactured by Grass® or Blum®.

A height 98 of door panels 42 is substantially equal to a height 100 of cabinet box 58. Likewise a width 102 of cabinet box 58 is substantially equal to a combined width 104 of the door panels 42 within upper cabinets 28. In a cabinet having a single door panel 42, the width of the cabinet box 58 would be substantially equal to the cabinet box width 106 of a single door panel 42. As a result of the full overlay construction of upper cabinet 28, the front-facing surfaces 80-88 of cabinet box 58 are substantially hidden from view when door panels 42 are closed. Front-facing surfaces 80-88 may further be colored with a gray or other neutral color paint or coating to minimize the visibility of cabinet box 58 when door panels 42 are closed. The interior surfaces 68, 108 of cabinet box 58 may be similarly colored.

A door handle 110 is coupled to each door panel 42. While door handle 110 is illustrated in FIG. 2 as a pull-style handle that couples to door panel 42 with a pair of handle fasteners 112, it is contemplated that different styles of door hardware may be used in alternative embodiments, such as, for example, a knob having a single fastener.

Figure 4:
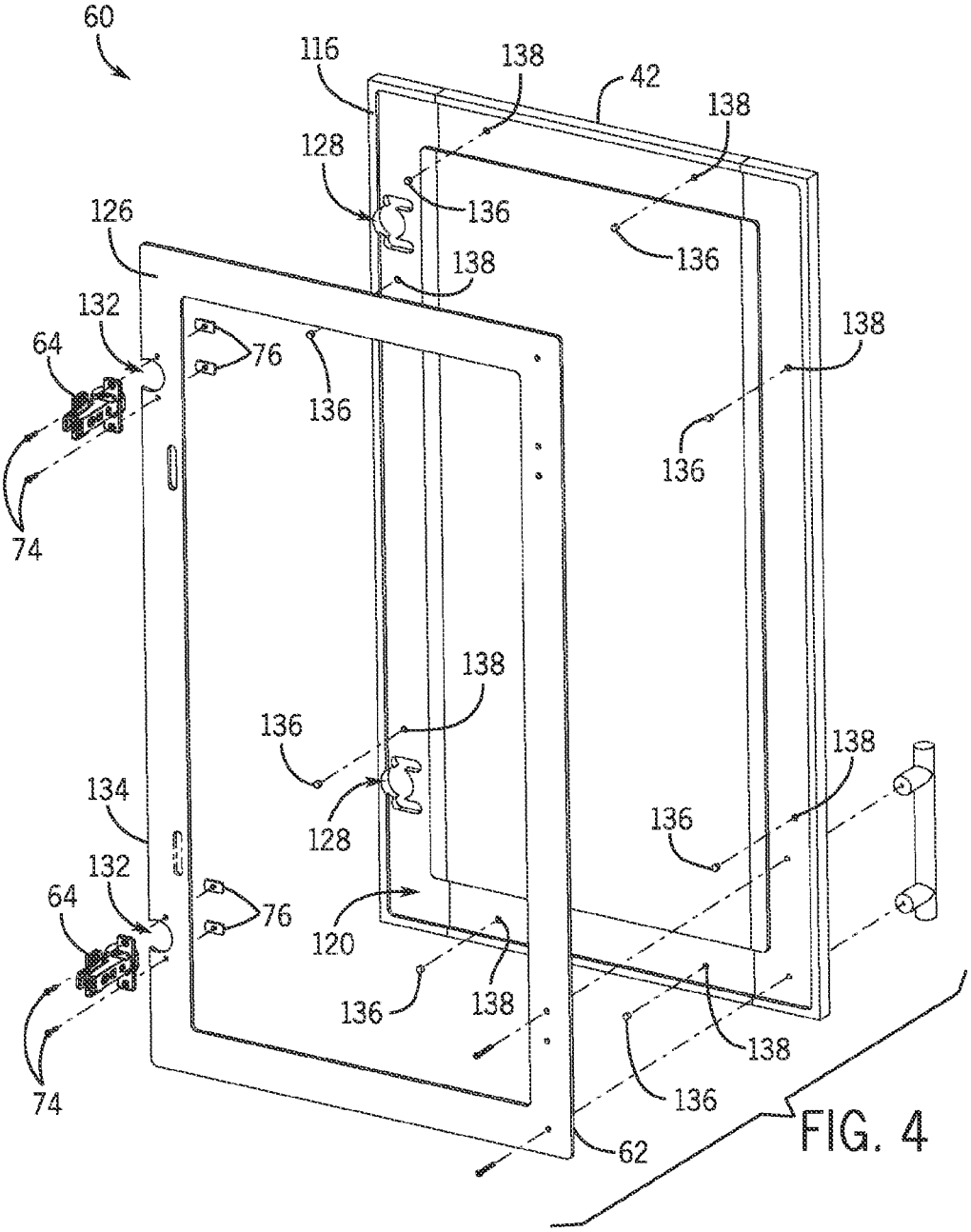
FIG. 4 is an exploded perspective view of a door assembly, according to an embodiment of the invention.
Figure 5:
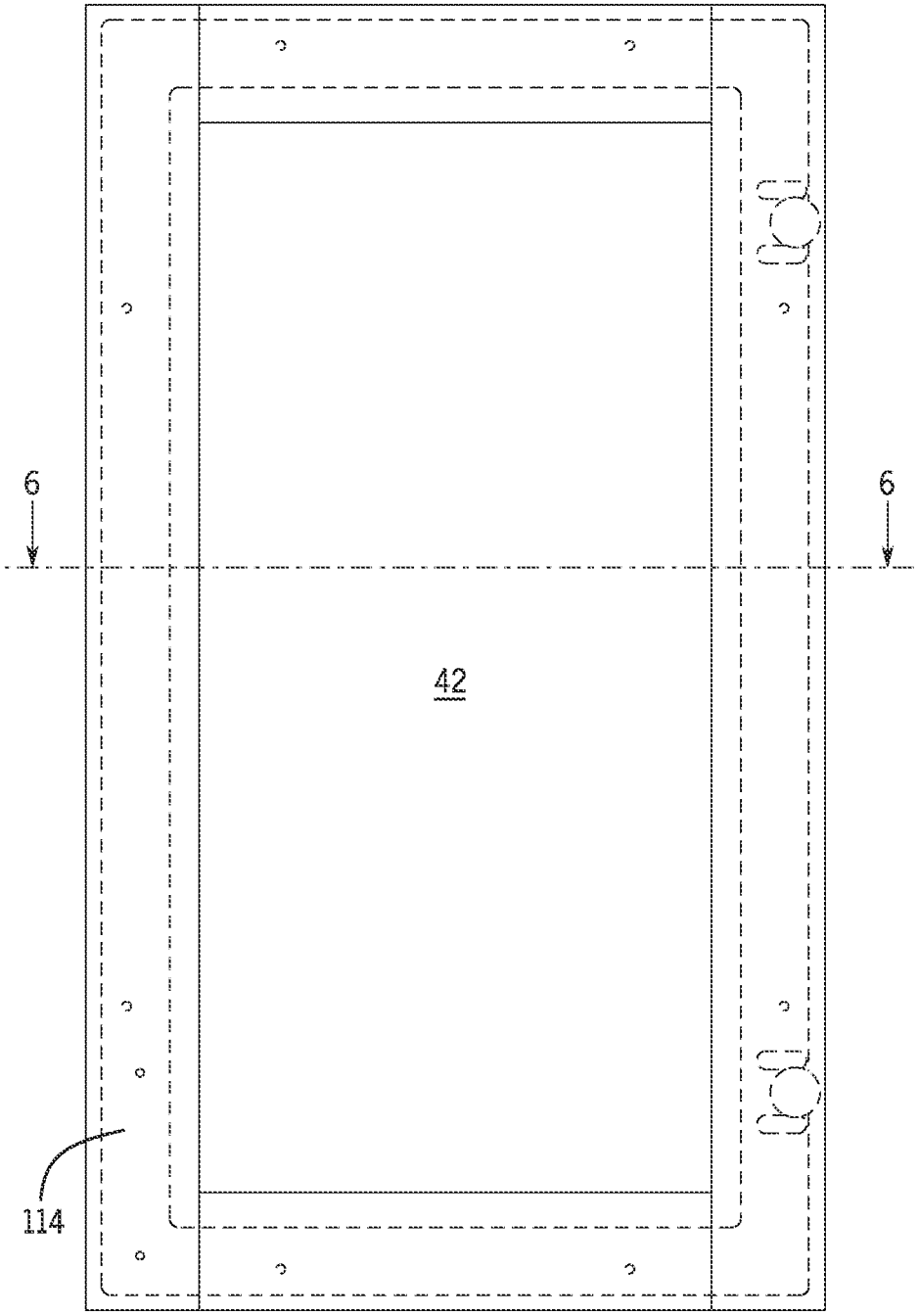
FIG. 5 is a front elevational view of a door panel of the door assembly of FIG. 4, according to an embodiment of the invention.
Figure 6:
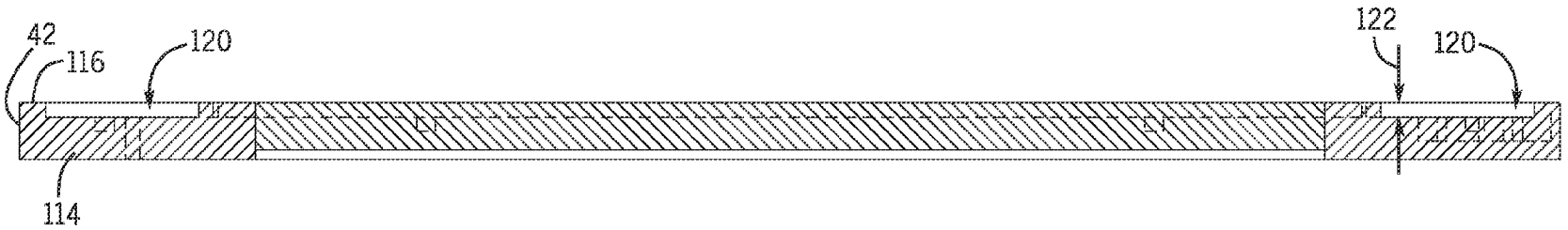
FIG. 6 is a sectional view of the door panel of FIG. 5.
Figure 9:
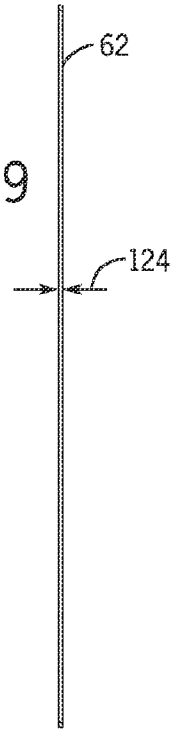
FIGS. 7, 8, and 9 are front, top, and side elevational views of a metal door panel of the door assembly of FIG. 4, according to an embodiment of the invention.
Figure 8:
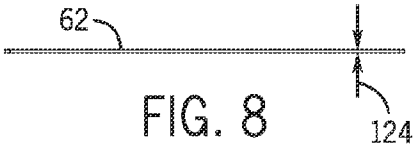
Figure 7:
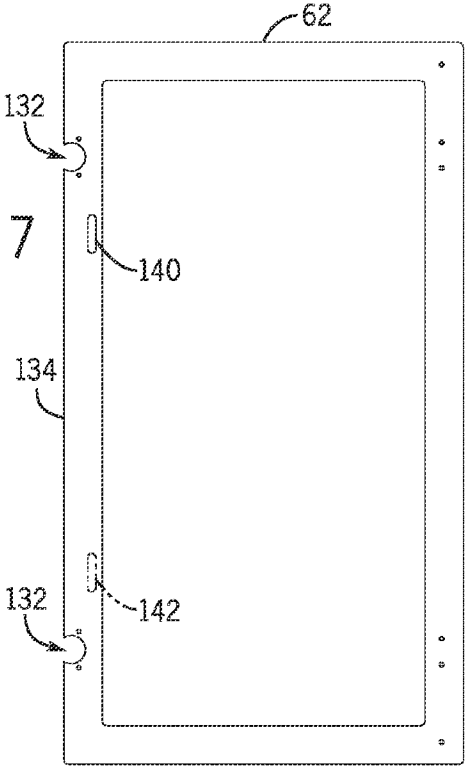

Additional views of door assembly 60 and the elements thereof are provided in FIGS. 4-9. FIG. 4 shows a rear exploded view of door assembly 60. FIG. 5 shows a front elevational view of door panel 42. FIG. 6 is a cross-sectional view taken along line 6-6 of FIG. 5. FIGS. 7-9 are front, top, and side elevational views of metal door plate 62. The construction of door assembly 60 is described below with reference to FIGS. 2-9 together where appropriate.

Door panel 42 includes a front surface 114, which forms the outward-facing surface of door panel 42, and a rear surface 116, which faces the interior 118 of cabinet box 58 (FIG. 2) when door assembly 60 is in a closed position. A cavity 120 is formed within the rear surface 116 of door panel 42 and is sized to receive metal door plate 62. In one embodiment, cavity 120 has a depth 122 substantially equal to a thickness 124 of metal door plate 62 such that a rear surface 126 of metal door plate 62 is substantially coplanar with rear surface 116 of door panel 42 when door assembly 60 is assembled.

In the illustrated embodiment, metal door plate 62 is constructed in the shape of a frame, with door panel 42 having a corresponding frame-shaped cavity 120. In alternative embodiments, it is contemplated that metal door plate 62 and cavity 120 may be constructed having other shapes without deviating from the scope of the invention. For example, metal door plate 62 may be provided as a rectangular slab without a central opening, or may be provided having a U-shape, L-shape, or C-shape, as described in more detail with respect to FIGS. 36-39. In any of these alternative embodiments, the shape of cavity 120 would be modified to have a geometry substantially equal to the shape of metal door plate 62, such that metal door plate 62 would be received within cavity 120, as described above.

Rear surface 116 of door panel 42 also includes a pair of recesses 128 sized to receive a protrusion 130 extending outward from the second hinge portion 72 of hinge assembly 64 and hinge nuts 76. A pair of notches 132 are formed along one edge 134 of metal door plate 62 and are positioned to align with the recesses 128 of door panel 42.

Door panel 42 is attached to metal door plate 62 with a plurality of magnets 136, which are positioned within corresponding circular recesses 138 formed within door panel 42. In one embodiment, magnets 136 are retained within circular recesses 138 with an adhesive (not shown). As shown in FIG. 3, circular recesses 138 extend inward from a portion of rear surface 116 that is adjacent cavity 120. In the illustrated embodiment, door assembly 60 includes a pair of magnets 136 positioned along each side of door panel 42. However, it is contemplated that alternative embodiments may include more or less magnets based on design specifications. In a preferred embodiment, magnets 136 are rare earth magnets and have a diameter of approximately ¼ inch.

Metal door plate 62 comprises a metallic material such as, for example, a powder-coated steel or other ferrous metal, which is magnetically attracted to magnets 136. When installing door panel 42 on upper cabinet 28, the magnetic attraction between magnets 136 inset within door panel 42 and metal door plate 62 serves to couple door panel 42 to metal door plate 62, with the engagement of metal plate 62 within cavity 120 functioning to self-align door panel 42 during installation. The magnetic properties of metal door plate 62 permit the inward-facing surface of metal door plate 62 to be utilized as a magnetic message center.

Metal door plate 62 is independently coupled to and aligned with cabinet box 58. Therefore, the engagement between metal door plate 62 and cavity 120 self-aligns door panel 42 with cabinet box 58 during the installation process. Handle fasteners 112 extend through metal door plate 62 and door panel 42 and serve to further secure door panel 42 to metal door plate 62.

To remove door panel 42 from metal door plate 62, door handle 110 is removed and a tool, such as removal tool 400 (FIG. 34), is inserted into a slot 140 formed within metal door plate 62. The tool is pressed or levered against the rear surface 116 of door panel 42 with enough force to overcome the magnetic attraction between metal door plate 62 and magnets 136. In one embodiment, the tool is provided having a plastic-coated or rubberized tip to minimize damage to the rear surface 116 of door panel 42. Alternatively, the portion of the rear surface 116 of door panel 42 beneath slot 140 may be lined with felt or another material to minimize wear or damage to rear surface 116. In another embodiment, an optional secondary slot 142 (shown in phantom) may be provided.

Referring now to FIGS. 36-39 together where appropriate, a door assembly 61 is shown according to another embodiment of the invention. Door assembly 61 includes a door panel 43, a door plate 63, and a pair of hinge assemblies 64 similar to those described with respect to FIG. 4. In one embodiment hinge fasteners 74 extend through hinge assemblies 64 and engage optional hinge nuts 76 (shown in phantom). In an alternative embodiment, hinge fasteners 74 engage threaded openings in door plate 63 and optional hinge nuts 76 are omitted. It is contemplated that a pair of door assemblies 61 may be coupled the cabinet box 58 of FIG. 2 in a similar manner as described above with respect to door assembly 60. As such, door assembly 61 has a height 99 substantially equal to a height 100 of cabinet box 58. Likewise, a width 103 of door assembly 61 is substantially equal to half of the total width 102 of the cabinet box 58.

Alternatively, the width 103 of door assembly 61 may be sized such that the single door panel 43 encloses the front opening of cabinet box 58 when in a closed position.

Door panel 43 includes a front surface 115, which forms the outward-facing surface of door panel 43, and a rear surface 117, which faces the interior 118 of cabinet box 58 (FIG. 2) when door assembly 61 is in a closed position. An open cavity or recess 121 is formed within the rear surface 117 of door panel 43 and is sized to receive door plate 63. In one embodiment, recess 121 has a depth substantially equal to a thickness 125 of door plate 63 such that a rear surface 127 of door plate 63 is substantially flush or coplanar with rear surface 117 of door panel 43 when door assembly 61 is assembled. In one embodiment, door plate 63 has a powder-coated finish selected to match the color of the rear surface 117 of door panel 43 and/or the interior of the cabinet box 58.

According the embodiment shown in FIGS. 36-39, door plate 63 has an L-shaped configuration that includes a horizontal portion 141 and a vertical portion 143 in which a pair of notches 132 sized to receive hinge assemblies 64 are formed. As shown, the width 105 of the horizontal portion 141 of door plate 63 is less than the overall width 103 of door panel 43. It is contemplated that the width 105 of the horizontal portion 141 may be selected to permit door plate 63 to be integrated into door assemblies of varying widths. As non-limiting examples, width 105 may be selected in a range of approximately 8-12 inches to allow door plate 63 to be integrated into door panels having a width of 24 inches or greater. Also, the length 107 of the vertical portion 143 of door plate 63 is less than the height 99 of door panel 43. Length 107 may be adjusted based on the dimensions of door plate 63, or may be selected to fit within a variety of different sized door panels. As one non-limiting example, length 107 may be in the range of approximately 25-29 inches to allow door plate 63 to fit within 30-inch, 36-inch, and 42-inch long door panels.

In an alternative embodiment, door plate 63 may be provided having a C-shaped geometry by the inclusion of an optional second horizontal portion 145 (shown in phantom). In such an embodiment, recess 121 would be formed having a corresponding geometry as shown in phantom.

Figure 36:
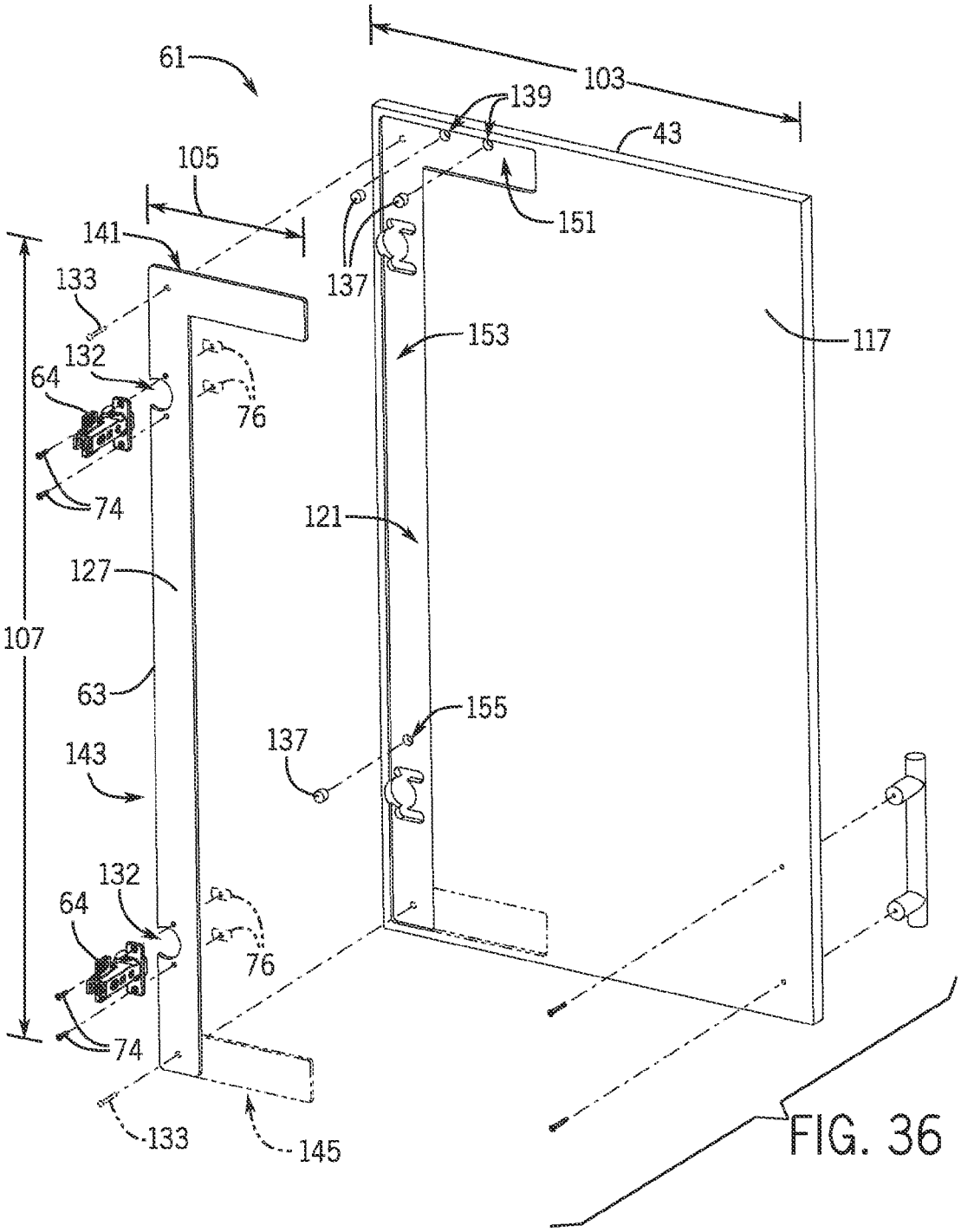
FIG. 36 is an exploded perspective view of a door assembly useable with the cabinetry system of FIG. 1, according to another embodiment of the invention.
Figure 37:
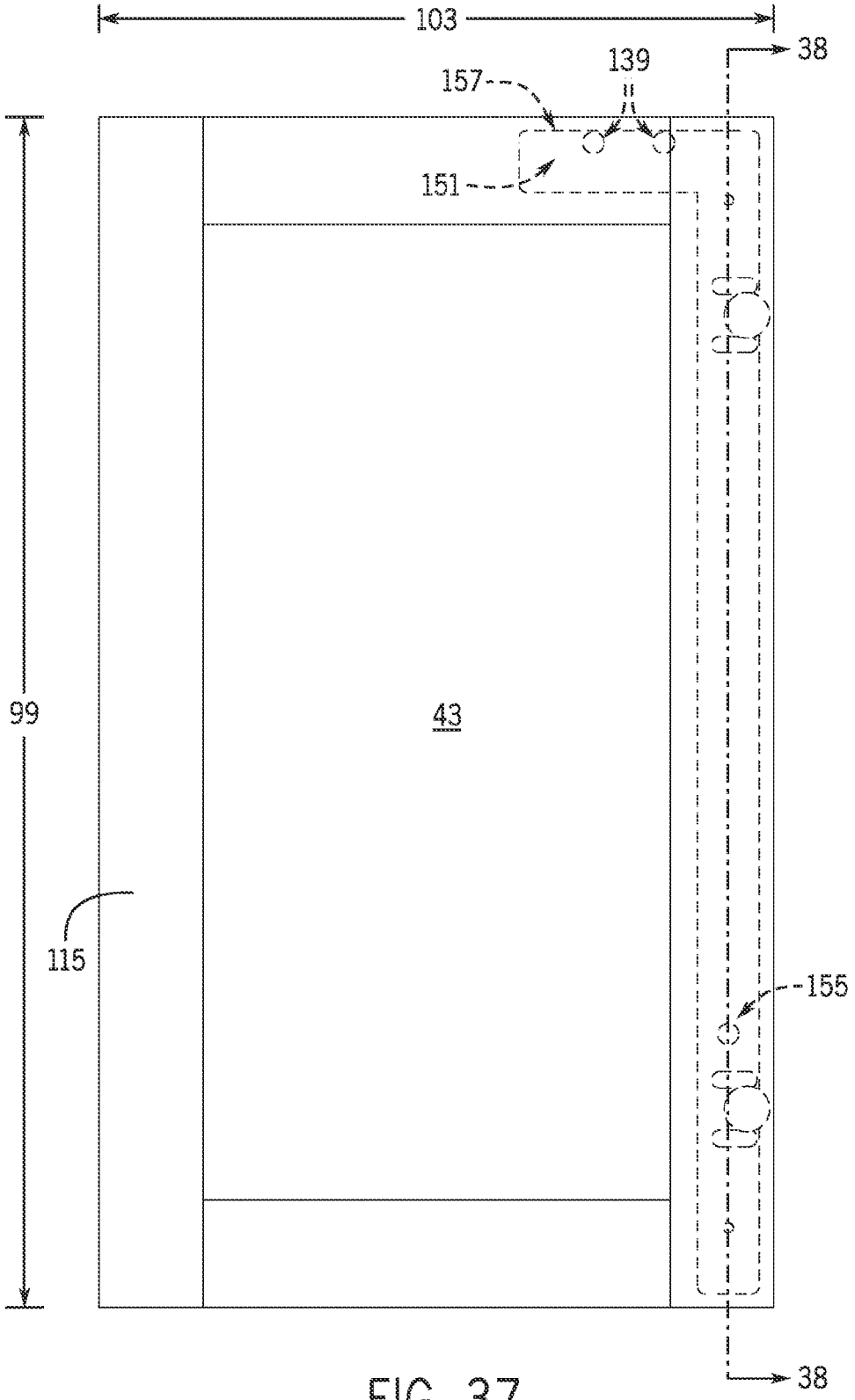
FIG. 37 is a front elevational view of the door assembly of FIG. 36, according to an embodiment of the invention.
Figure 38:
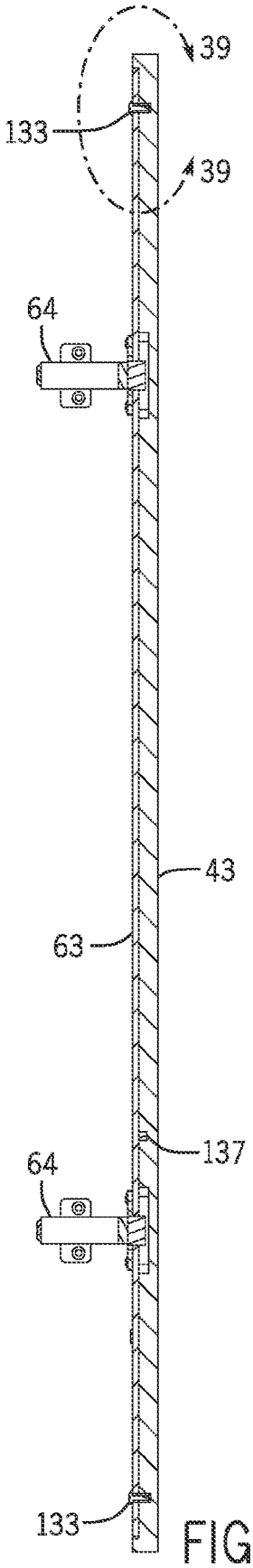
FIG. 38 is a sectional view of the door assembly of FIG. 37.
Figure 39:
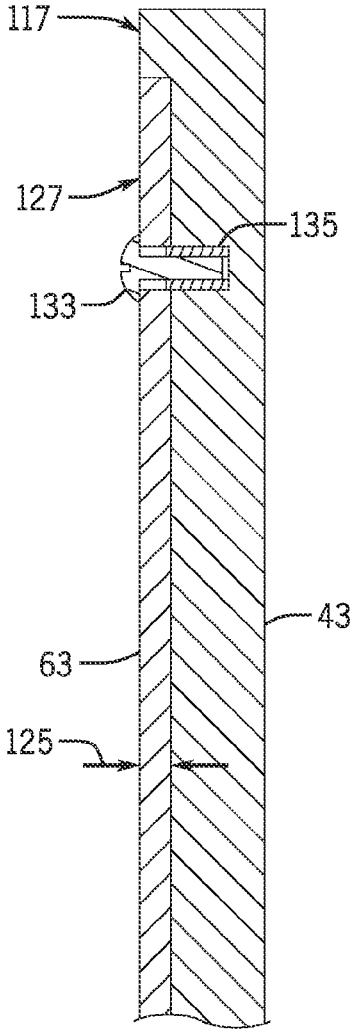
FIG. 39 is a detail view of a portion of the door assembly of FIG. 37.

Similar to door panel 42 of FIG. 4, door panel 43 of FIGS. 36-39 is attached to door plate 63 with a plurality of magnets 137, which are positioned within corresponding circular recesses 139, 155 formed within door panel 43. Magnets 137 are positioned within recesses 139, 155 such that the outward facing surface thereof is substantially coplanar with rear surface 117 of door panel 43. In one embodiment, magnets 137 are retained within circular recesses 139, 155 with an adhesive (not shown). As shown in FIG. 36, circular recesses 139, 155 extend inward from a portion of rear surface 117 that is adjacent recess 121.

In a preferred embodiment, door assembly 61 includes three (3) rare earth magnets 137 that have a pull force in a range of approximately 15-20 lbs. A pair of the magnets 137 is positioned within recesses 139 formed behind a horizontal portion 151 of recess 121. The third magnet 137 is positioned within a recess 139 formed behind a vertical portion 153 of recess 121. This arrangement of magnets 137 creates three magnetic attachment points that couple door plate 63 to door panel 43. However, it is contemplated that alternative embodiments may include more or less magnets and magnets having a pull force less than 15 lbs or greater than 20 lbs based on design specifications.

Door plate 63 comprises a metallic material such as, for example, a cold-rolled steel or other ferrous metal, which is magnetically attracted to magnets 137. When installing door panel 43 on upper cabinet 28 (FIG. 1), the magnetic attraction between magnets 137 inset within door panel 43 and door plate 63 serves to couple door panel 43 to door plate 63, with the engagement of door plate 63 within recess 121 functioning to self-align door panel 43 during installation. When installed, the outward-facing surfaces of magnets 137 are directly coupled to door plate 63. In an alternative embodiment there may be a very small (e.g., 1 mm or less) air gap between magnets 137 and door plate 63. In a preferred embodiment, recesses 139 are positioned such that the top surface thereof is substantially aligned with the upper edge or top surface 157 of horizontal portion 151 of recess 121 to engage the magnetic connection between the upper pair of magnets 137 and the door plate 63 as early as possible in the assembly process. Specifically, when coupling door panel 43 to door plate 63, the top edge of door panel 43 may be tilted down toward the upper edge of the horizontal portion 141 of door plate 63 until the pair of magnets 137 within recesses 139 engage horizontal portion 141. This initial magnetic engagement supports a portion of the weight of the door panel 43 while door panel 43 is further tilted down until the third magnet 137 magnetically couples to the vertical portion 143 of door plate 63.

Optional fasteners 133 (shown in phantom) extend through door plate 63 and are received within door panel 43 to further secure door panel 43 to door plate 63. In one embodiment, fasteners 133 are received within optional threaded inserts 135 (shown in phantom), which are inset within recess 121. Threaded inserts 135 may be metal or plastic according to alternative embodiments. Similar threaded inserts may be included within the door assembly 60 of FIG. 4. In the embodiment shown, two (2) pairs of fasteners 133 and threaded inserts 135 are used to secure door plate 63 to door panel 43. However, it is contemplated that more or less pairs of fasteners 133 and threaded inserts 135 may be used in alternative embodiments based on the size of the door panel 43 and strength of the magnets 137.

In one embodiment, door plate 63 may be provided having a bevel (not shown) that is received within a corresponding beveled recess (not shown) of recess 121 to aid in retaining door plate 63 in position during the assembly process. In one non-limiting embodiment, the bevel of door plate 63 may have an angle of approximately 30 degrees. However, it is contemplated that the angle may be varied in alternative embodiments.

Figure 10:
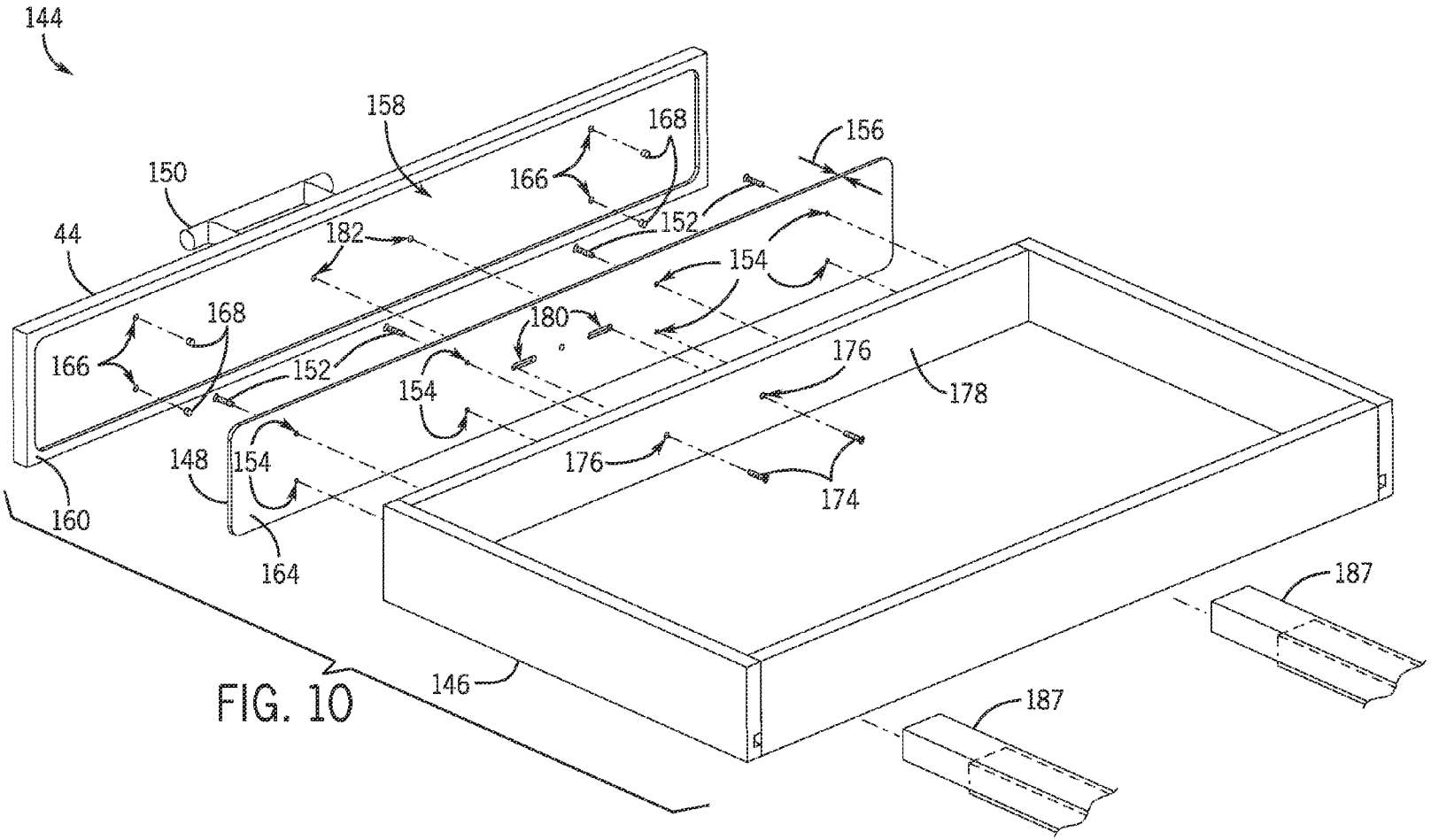
FIG. 10 is an exploded perspective view of a drawer assembly useable with the cabinetry system of FIG. 1, according to an embodiment of the invention.
Figure 12:
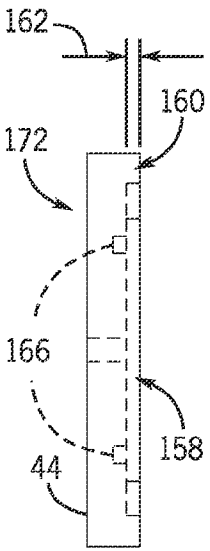
FIGS. 11, 12, 13, and 14 are respective front, top, side, and rear elevational views of a drawer panel of the drawer assembly of FIG. 10.
Figure 13:
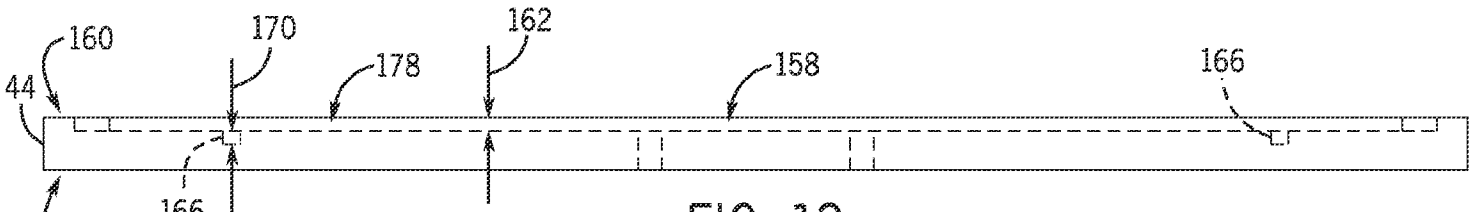
Figure 11:
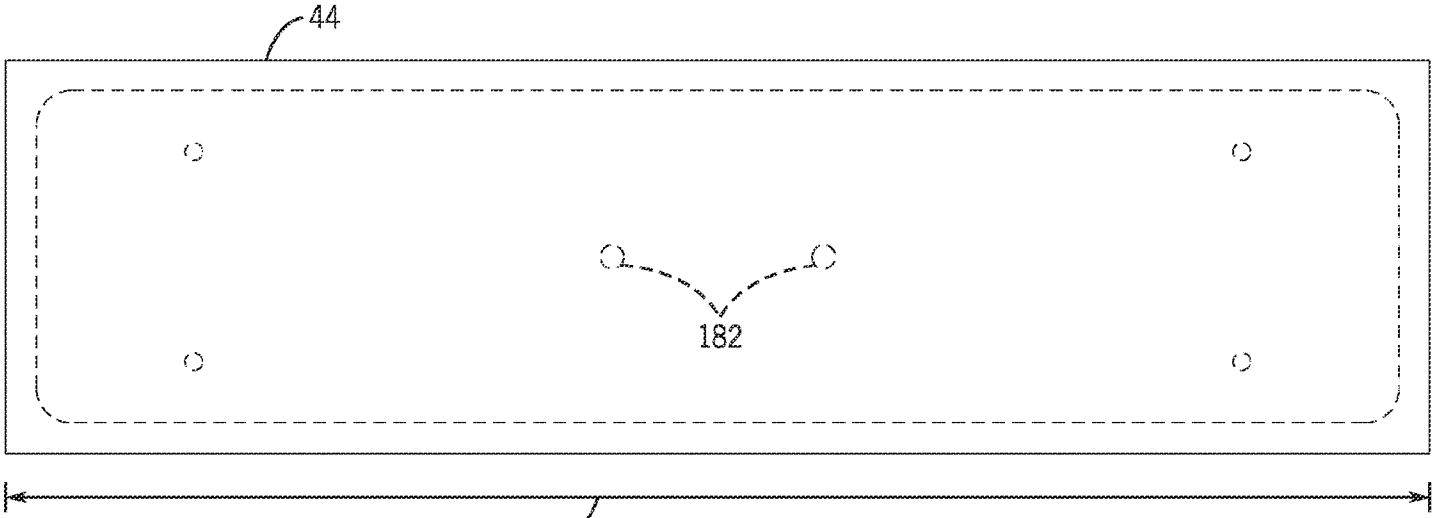
Figure 14:
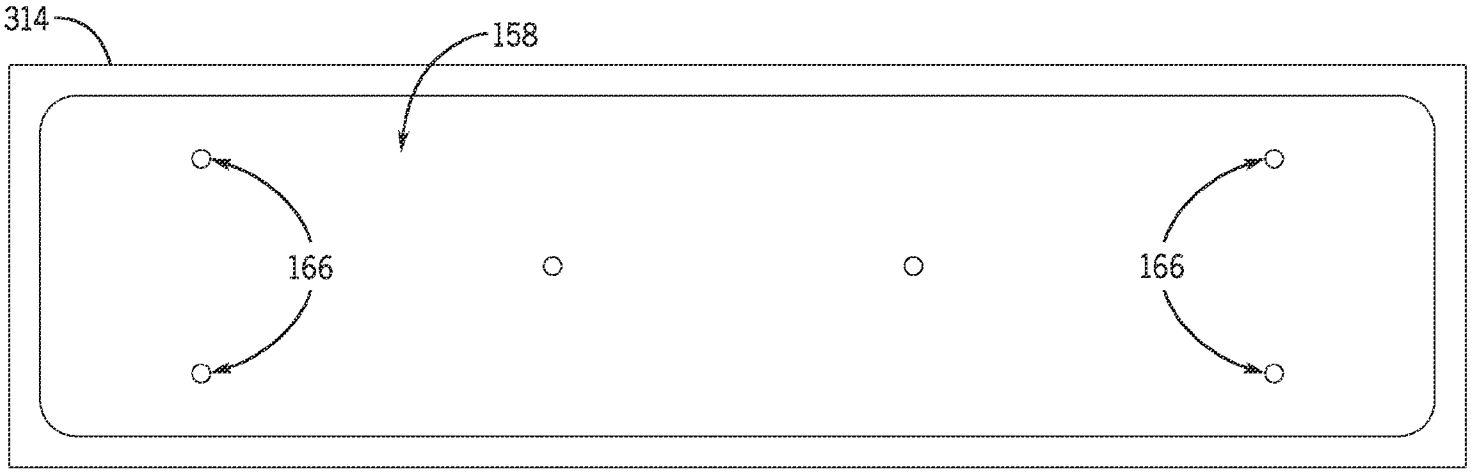
Figure 15:
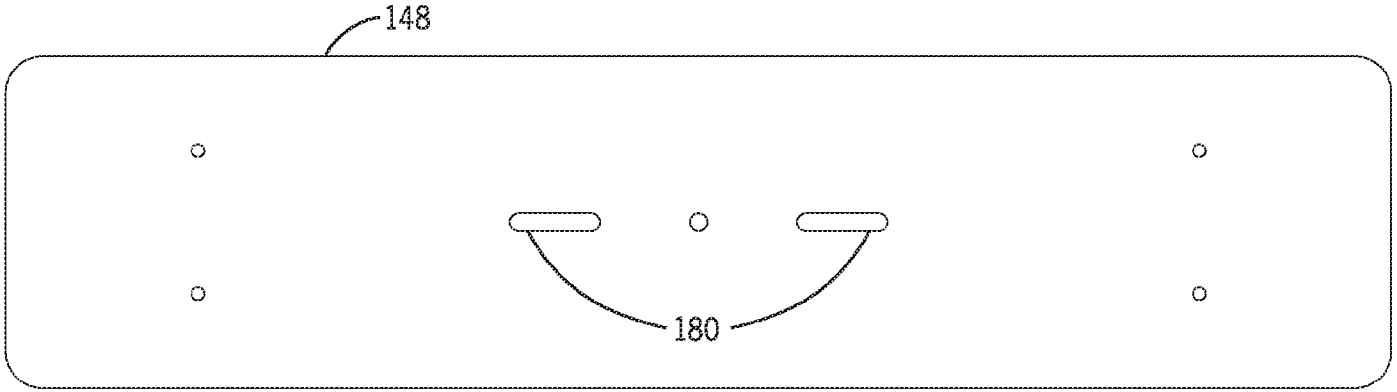
FIG. 15 is a front view of a metal drawer plate of the drawer assembly of FIG. 10.

Referring now to FIG. 10, an exemplary drawer assembly 144 is illustrated according to one embodiment of the invention. Drawer assembly 144 includes a drawer box 146, a metal drawer plate 148, a drawer panel 44, and a drawer handle 150. Additional details of metal drawer plate 148 and drawer panel 44 are shown in FIGS. 11-15. As such, FIGS. 10-15 are described together below as appropriate.

Similar to metal door plate 62, metal drawer plate 148 comprises a magnetic material such as steel or other ferrous metal. Metal drawer plate 148 is coupled to drawer box 146 via a plurality of fasteners 152 that are received within openings 154 formed through the thickness 156 of metal drawer plate 148. In the illustrated embodiment, metal drawer plate 148 has a generally rectangular shape. However, it is contemplated that the shape of metal drawer plate 148 may be modified in alternative embodiments. As one non-limiting example, metal drawer plate 148 may be constructed in a T-shape or in the shape of a cross shape.

Drawer panel 44 has a cavity 158 formed in a rear surface 160 thereof for receiving metal drawer plate 148. As shown, the geometry of cavity 158 is substantially equal to that of metal drawer plate 148 with a depth 162 substantially equal to the thickness 156 of metal drawer plate 148. When drawer assembly 144 is assembled, metal plate 148 is received within cavity 158 and the rear surface 164 of metal plate 148 is coplanar or flush with the rear surface 160 of drawer panel 44. The engagement of metal plate 148 within drawer panel cavity 158 functions to self-align drawer panel 44 with drawer box 146 when installing drawer panel 44.

A plurality of magnet recesses 166 extend inwardly from the surface 160 of drawer panel 44 and are sized to receive magnets 168, which are retained within magnet recesses 166 of drawer panel 44 with an adhesive (not shown). The depth 170 of magnet recesses 166 is substantially equal to a thickness of magnets 168 so that an outward facing surface of magnets 168 does not extend beyond the portion of rear surface 160 within drawer panel cavity 158.

Drawer handle 150 is coupled to a front surface 172 of drawer panel 44 using one or more fasteners 174, which extend through openings 176 in a front panel 178 of the drawer box 146, openings 180 in metal drawer plate 148, and finally through openings 182 in drawer panel 44 to engage drawer handle 150. As shown, metal drawer plate 148 may be manufactured having a plurality of metal plate openings 180 to accommodate various types of drawer hardware. In the illustrated embodiment, metal drawer plate 148 is provided having a pair of slotted openings to accommodate door hardware of various widths and a central circular opening to accommodate knob-style hardware. However, it is contemplated that metal drawer plate 148 may be provided with a single opening to receive a fastener for knob-style hardware or a pair of circular openings spaced to receive fasteners for pull-style hardware of predetermined width.

Drawer assembly 144 is received within a drawer opening 184 of a structural frame or cabinet box, such as lower cabinet box 186 of FIGS. 16-19, which corresponds to base cabinet 38 of FIG. 1. Drawer assembly 144 is mounted to lower cabinet box 186 with drawer slide hardware 187. In one embodiment, drawer slide hardware 187 comprises under-mount soft-closing drawer slides. When drawer assembly 144 is positioned in a closed position within lower cabinet box 186, the rear surface 160 of drawer panel 44 rests against front-facing surfaces 188, 190, 192, 194 of lower cabinet box 186. Similar to door assembly 60, drawer assembly 144 is constructed having a full overlay construction, with the drawer width 196 substantially equal to the width 198 of lower cabinet box 186 between side panels 200, 202. As such, front-facing surfaces 188-194 of lower cabinet box 186 are substantially hidden from view when drawer assembly 144 is in a closed position.

A door assembly, similar to door assembly 60 (FIG. 4), may be provided to enclose the lower compartment 204 of lower cabinet box 186. Alternatively, lower cabinet box 186 may be constructed to receive one or more additional drawer assemblies, similar to drawer assembly 144.

To remove drawer panel 44 from drawer assembly 144, drawer assembly 144 is positioned in a fully extended or open position and drawer handle 150 is removed by unscrewing fasteners 174. Drawer panel 44 is then pulled backwards or away from drawer box 146 until the magnetic attraction between magnets 168 and metal plate 148 is overcome and drawer panel 44 disengages from metal plate 148.

The construction of door assemblies 60, 61 and drawer assemblies 144 facilitates removal and installation of door panels 42, 43 and drawer panels 44 within cabinetry system 10. Because the full overlay construction substantially hides the upper cabinet boxes 58 and lower cabinet boxes 186 behind the respective door panels 42 and drawer panels 44, the aesthetics of the cabinetry system 10 may be altered by simply replacing one set of door and drawer panels 42, 44 with another set of door and drawer panels 42, 44 of different color and/or style. The incorporation of metal door plate 62 into door assembly 60 and metal plate 148 into drawer assembly 144 assists to properly align the new door and drawer panels 42, 44 with the upper cabinet boxes 58 and lower cabinet box 186.

Figure 16:
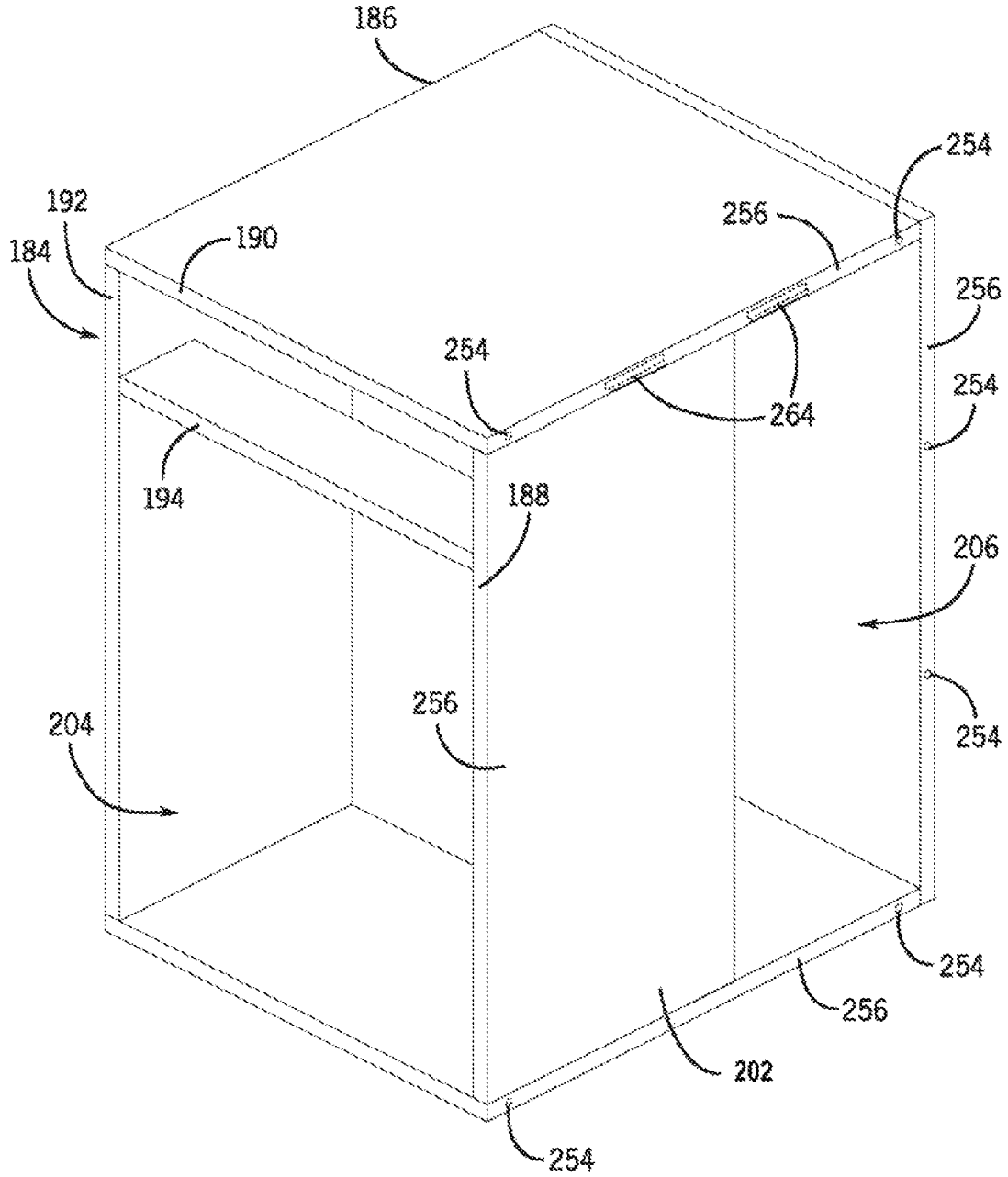
FIG. 16 is a perspective view of a base cabinet box having a storage compartment that is useable with the cabinetry system of FIG. 1, according to an embodiment of the invention.
Figure 17:
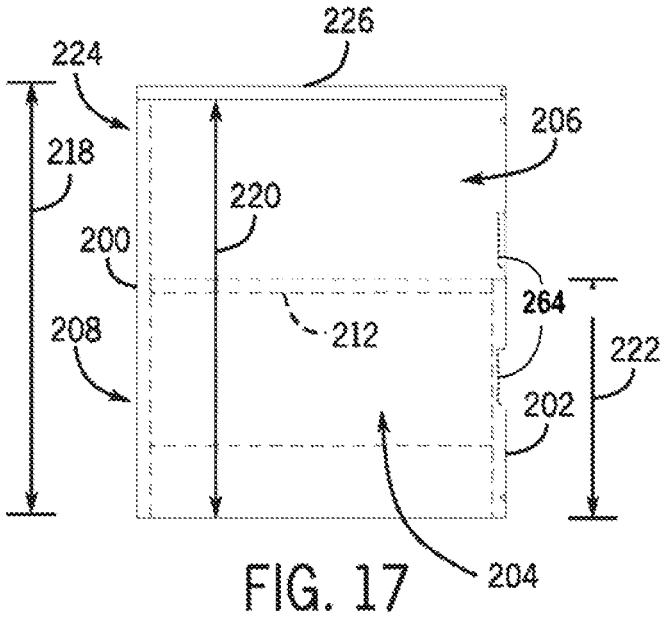
FIGS. 17, 18, and 19 are respective top, front, and side elevational views of the base cabinet box of FIG. 16.
Figure 18:
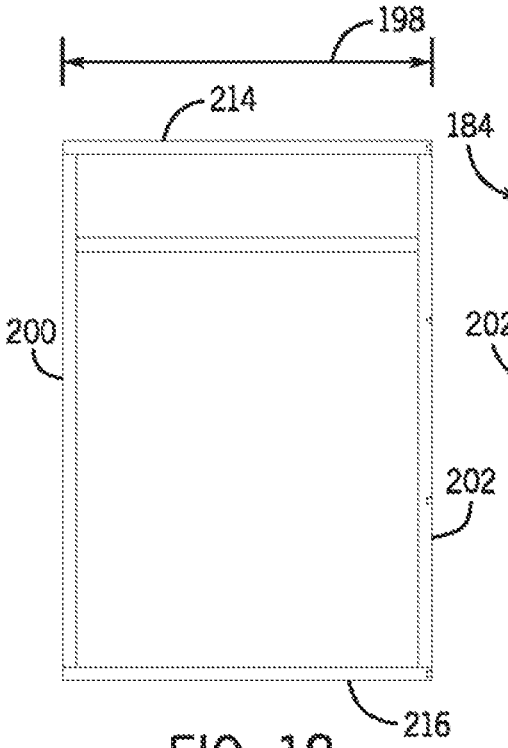
Figure 19:
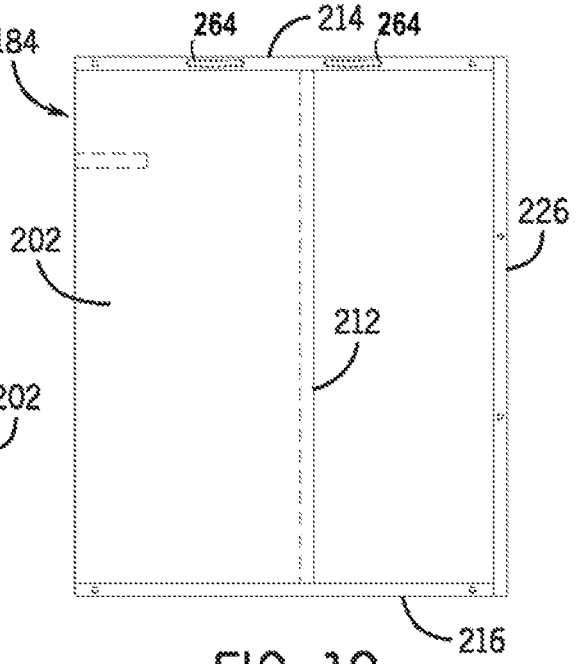

In one embodiment of the invention, cabinetry system 10 includes storage compartments within which one set of door and drawer panels 42, 44 may be stored when a second set of door and drawer panels 42, 44 are in use. FIG. 16 illustrates one such base cabinet storage compartment 206 that may be provided within one or both of base cabinets 36, 40 of cabinetry system 10 (FIG. 1). As shown in FIG. 16, lower cabinet box 186 includes a drawer opening 184 sized to receive drawer assembly 144 (FIG. 10) and a lower compartment 204, which is partially enclosed by a first portion 208 of a first side panel 200, second side panel 202, a dividing panel 212, a top panel 214, and a bottom panel 216. The width 218 of first side panel 210 is equal to the interior depth 220 of lower cabinet box 186. The width 222 of second side panel 202 is less than lower cabinet box depth 220. The base cabinet storage compartment 206 is formed in the rear portion of lower cabinet box 186 between a second portion 224 of first side panel 210, dividing panel 212, and a rear panel 226 of lower cabinet box 186. Base cabinet storage compartment 206 provides storage for a number of door panels 42 and/or drawer panels 44 when not in use. In one embodiment, one or more divider panels (not shown) may be positioned within base cabinet storage compartment 206 to create storage slots for door panels 42 and/or drawer panels 44. Tool 400 also may be stored within base cabinet storage compartment 206.

Figure 20:
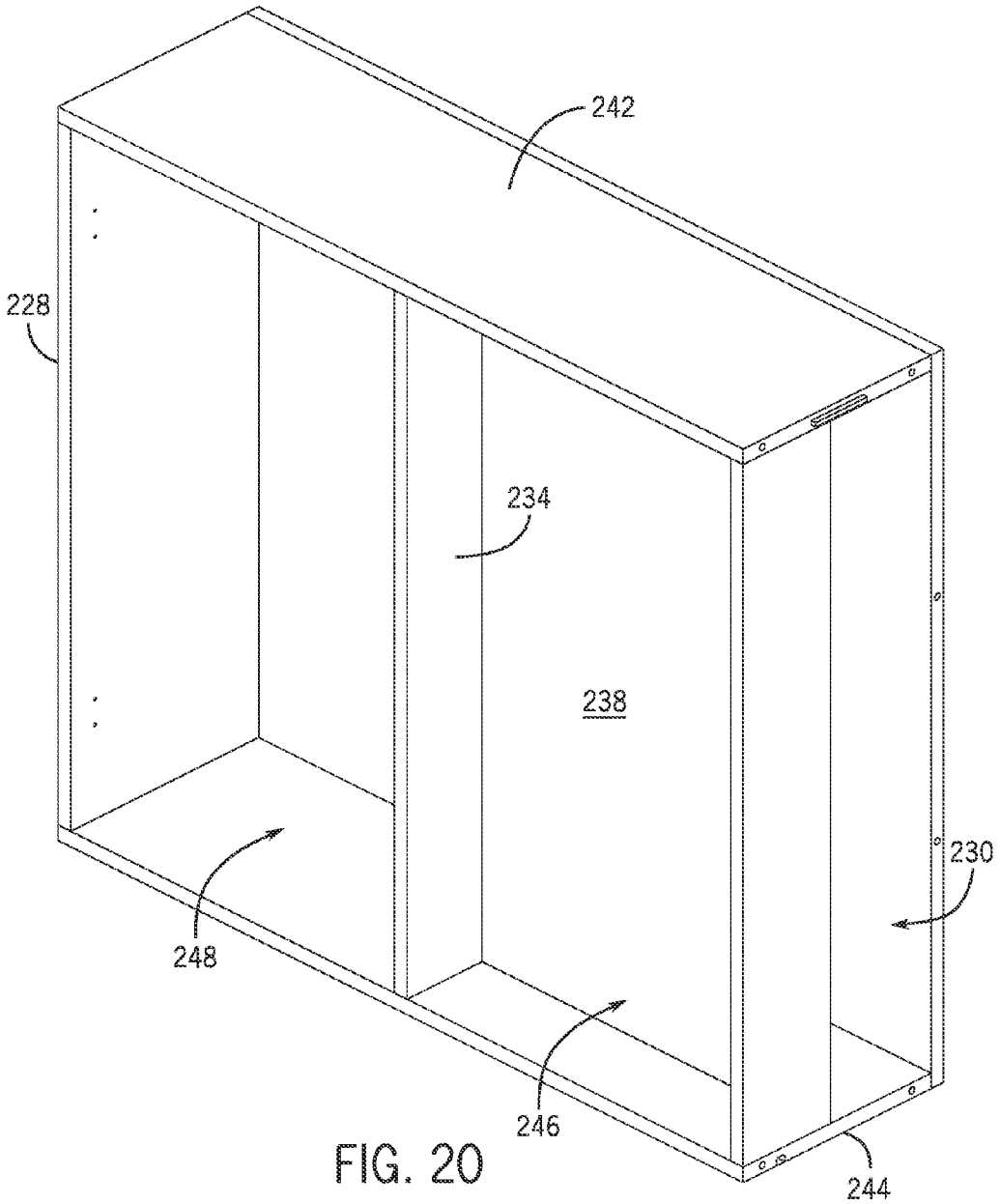
FIG. 20 is a perspective view of an upper cabinet box having a storage compartment that is useable with the cabinetry system of FIG. 1, according to an embodiment of the invention.
Figure 24:
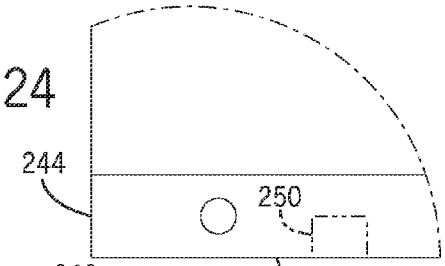
FIG. 24 is a detailed view of an optional recess for lighting provided in the upper cabinet box of FIG. 20, according to an embodiment of the invention.
Figure 23:
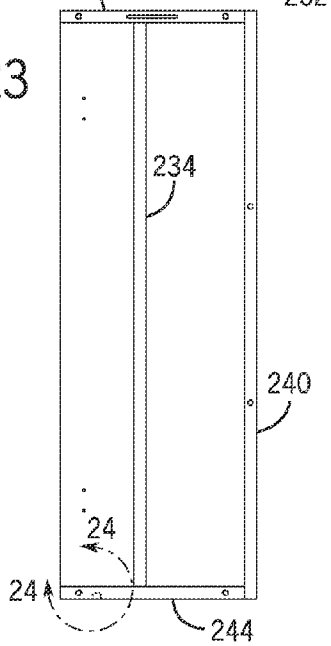
FIGS. 21, 22, and 23 are respective top, front, and side elevational views of the upper cabinet box of FIG. 20.
Figure 21:
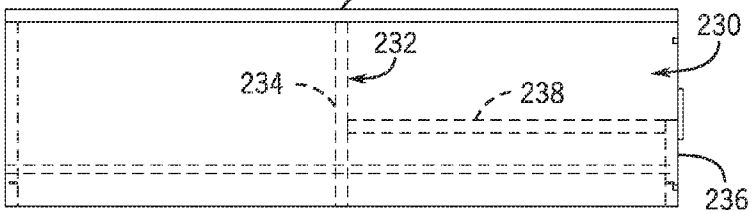
Figure 22:
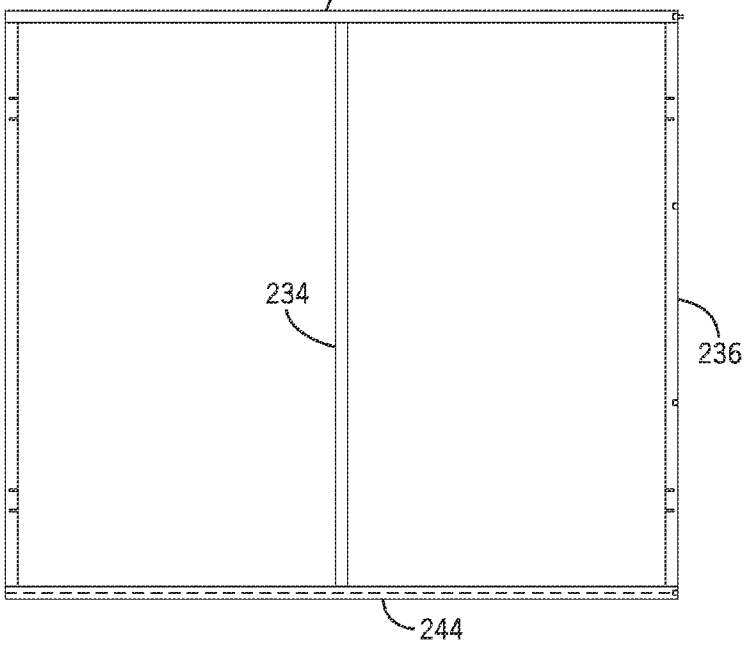

Similar storage compartments may be provided in one or both of upper cabinets 30, 32. As shown in FIG. 20, upper cabinet box 228 includes an upper cabinet storage compartment 230, which is partially enclosed by a first portion 232 of a central panel 234, a side panel 236, a dividing panel 238, a rear panel 240, and top and bottom panels 242, 244. The front compartment 246 of upper cabinet box 228 may be provided with a number of shelves (not shown) to serve as a spice cabinet or glassware cabinet. It is contemplated that one or more shelves (not shown) may likewise be positioned within left compartment 248 of upper cabinet box 228.

Optionally, a dado or groove 250 (shown in phantom) may be formed in a lower surface 252 of bottom panel 244 for receiving under cabinet strip lighting (not shown). Upper cabinets 24, 28, 32 may include a similar dado or groove. Further, it is contemplated that the cabinet boxes of base cabinets 34, 36 and upper cabinet 28 are constructed similar to lower cabinet box 186 and upper cabinet box 228, albeit with the storage compartments 206, 230 omitted.

Figure 25:
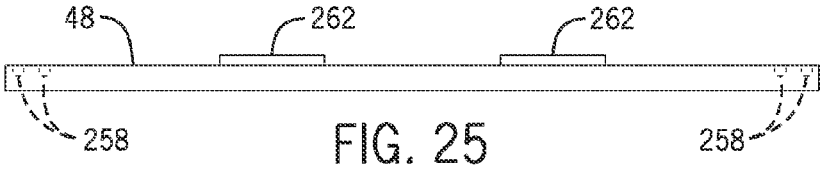
FIGS. 25, 26, and 27 are respective top, front, and side elevational views of an end panel useable with the cabinetry system of FIG. 1.
Figure 26:
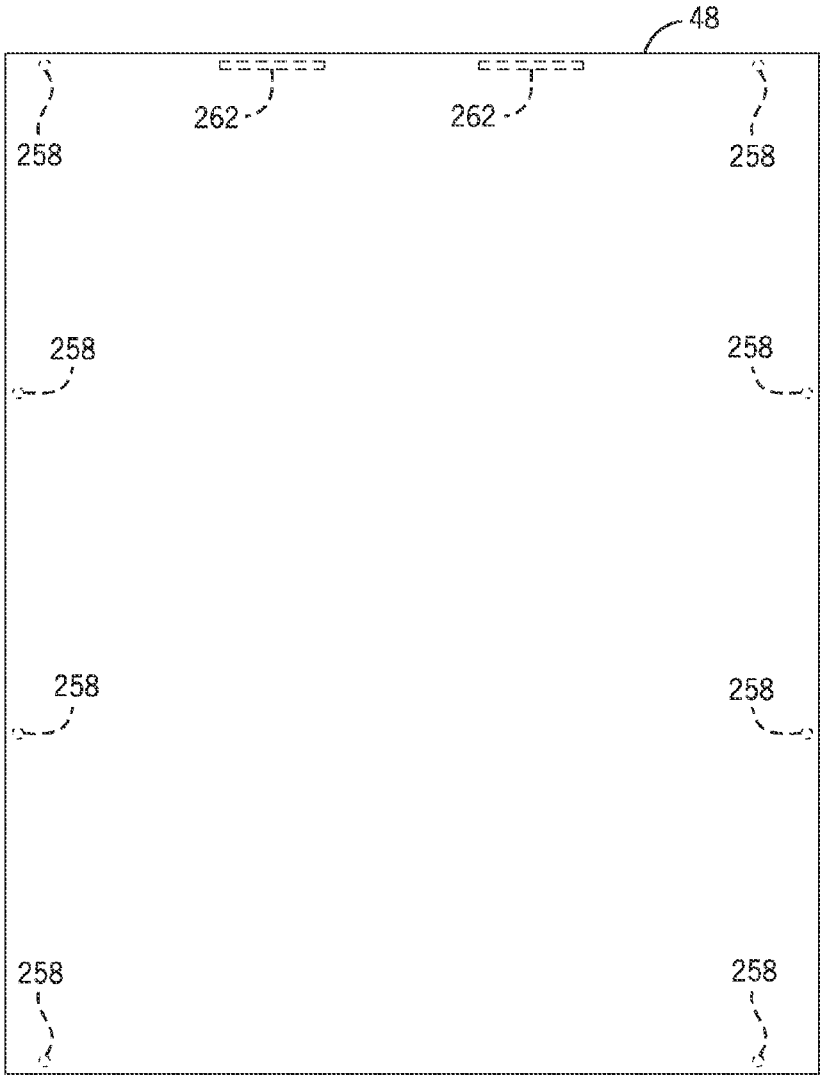
Figure 27:
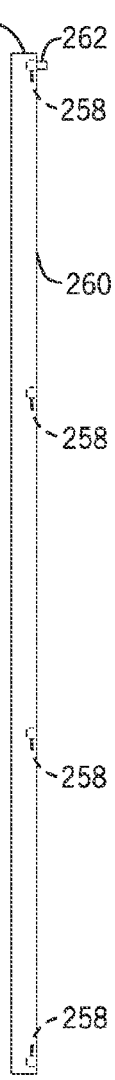

End panels 46, 48 couple to upper cabinet box 228 and lower cabinet box 186 and hide the contents of upper cabinet storage compartment 230 and base cabinet storage compartment 206 from view. While end panel 48 is illustrated in FIGS. 25-27, one skilled in the art will recognize that end panel 46 and upper cabinet box 228 may be configured in a similar manner. Referring to FIGS. 16 and 25-27 together, a plurality of base cabinet magnets 254, similar to magnets 136, are recessed within end surfaces 256 of lower cabinet box 186 at locations that align with the locations of end panel magnets 258 recessed within an inward-facing surface 260 of end panel 48. The magnetic attraction between base cabinet magnets 254 and end panel magnets 258 aids in aligning end panel 48 with lower cabinet box 186 during installation. While end panel magnets 258 are illustrated about the outer perimeter of end panel 48, additional magnets may be provided in a central region of panel 48.

In one embodiment, one or more bosses or protrusions 262 extend outward from end panel 48 and are received within corresponding one or more slots 264 formed within one or more end surfaces 256 of lower cabinet box 186. Alternatively, protrusions may be extended outward from lower cabinet box 186 and slots 264 may be formed within end panel 48. The engagement between slot(s) 264 and protrusion(s) 262 support the weight of end panel 48 and aid in retaining end panel 48 on base cabinet 36. A similar arrangement of magnets, slots, and bosses is contemplated to attach end panel 46 to upper cabinet box 228. As non-limiting examples protrusions 262 may be provided as metal brackets coupled to base cabinet 36 or wood or metal dowels protruding outward from base cabinet 36.

Figure 35:
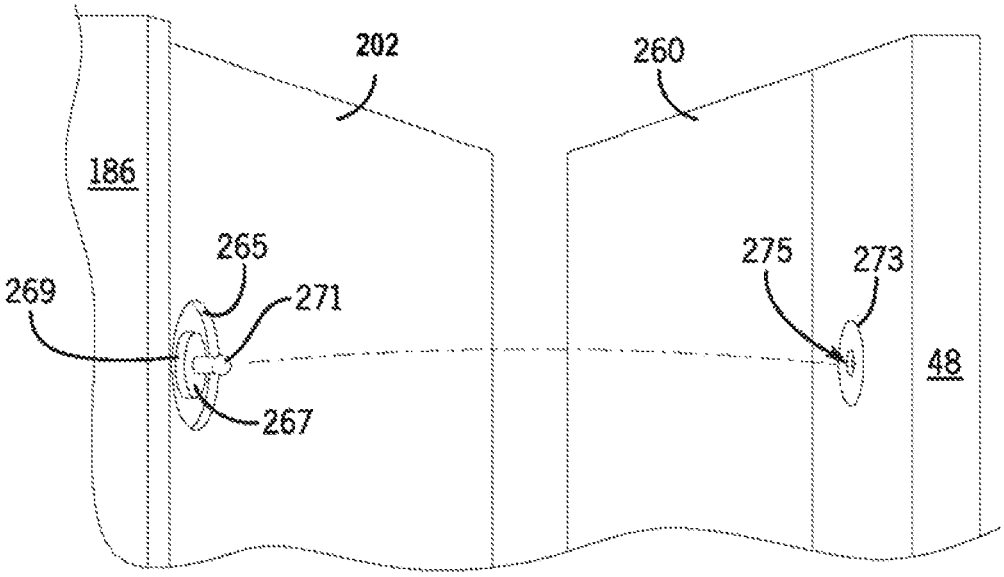
FIG. 35 is a detailed view of hardware components used to align and attach an end panel of the cabinetry system of FIG. 1 to a base cabinet box, in accordance with an alternative embodiment.

In an alternative embodiment illustrated in FIG. 35, a self-centering locating pin assembly having a pin body 269 and a receiving body 273 are used to retain end panel 48 on base cabinet box 186 in combination with corresponding pairs of magnets 254. As shown, pin body 269 includes a base portion 267 that is positioned within a recess 265 formed on side panel 202 of base cabinet box 186 and a stem portion 271 extending outwardly therefrom. Stem portion 271 is received within an opening 275 formed within receiving body 273.

Figure 28:
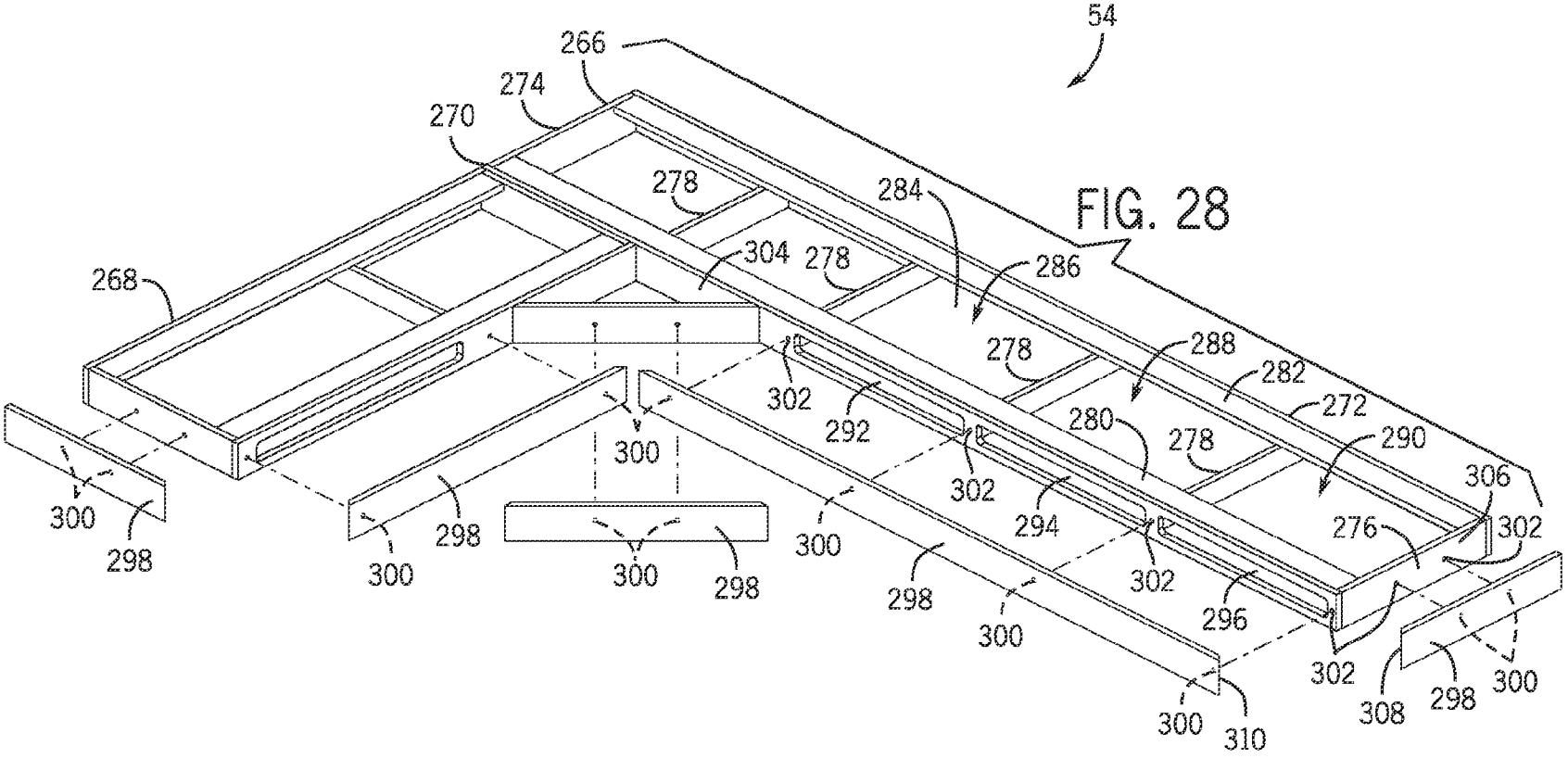
FIG. 28 is an exploded perspective view of a toe kick assembly of the cabinetry system of FIG. 1.

Referring now to FIG. 28, a toe kick assembly 54 is disclosed according to one embodiment of the invention. Toe kick assembly 54 includes a toe kick storage frame 266, which is positioned beneath first portion 18 of lower cabinet assembly 14 (FIG. 1) and provides additional storage compartments for door panels and/or drawer panels. A similar toe kick storage frame 268 is positioned beneath second portion 22 of lower cabinet assembly 14 and is manufactured in a similar manner as toe kick storage frame 266 described below.

Toe kick storage frame 266 includes a front panel 270 and a rear panel 272 coupled together by a pair of side panels 274, 276. One or more support panels 278 are provided between side panels 274, 276 to provide structural support for lower cabinet assembly 14. The number of support panels 278 may be varied based on the overall length of the first portion 18 of lower cabinet assembly 14. A pair of top support panels 280, 282 extend along the top surfaces of support panels 278 and are coupled to side panels 274, 276, front panel 270, and rear panel 272 as shown. In an alternative embodiment, a single top support panel may be provided that spans the distance between front panel 270 and rear panel 272.

A bottom panel 284 forms the bottom surface of three individual storage compartments 286, 288, 290 formed within storage frame 266. Bottom panel 284 may be lined with a protective material such as felt, for example, to protect the surface of bottom panel 284 from wear. Openings 292, 294, 296 extend through front panel 270 and provide access to compartments 286, 288, 290.

Toe kick assembly 54 includes facie panels 298, which are provided having a similar color or wood style to coordinate with door panels 42 and drawer panels 44. Facie panels 298 are magnetically coupled to toe kick storage frame 266 in a similar manner as described with respect to end panel 48 and lower cabinet box 186. In particular, a number of magnets 300 are recessed within respective inward-facing surfaces of each facie panel 298. Corresponding magnets 302 are recessed within respective outward-facing surfaces 304, 306 of front panel 270 and side panel 276. In one embodiment, toe kick assembly 54 also includes magnets 300 embedded within the mating end surfaces 308, 310 of facie panels 298. According to one non-limiting embodiment, magnets 300, 302 are positioned every 18-24 along the length of facie panels 298 and panels 270, 276. In an alternative embodiment, magnets may be positioned in pairs (one high magnet and one low magnet) along the length of each panel 298, 270, 276.

Figure 29:
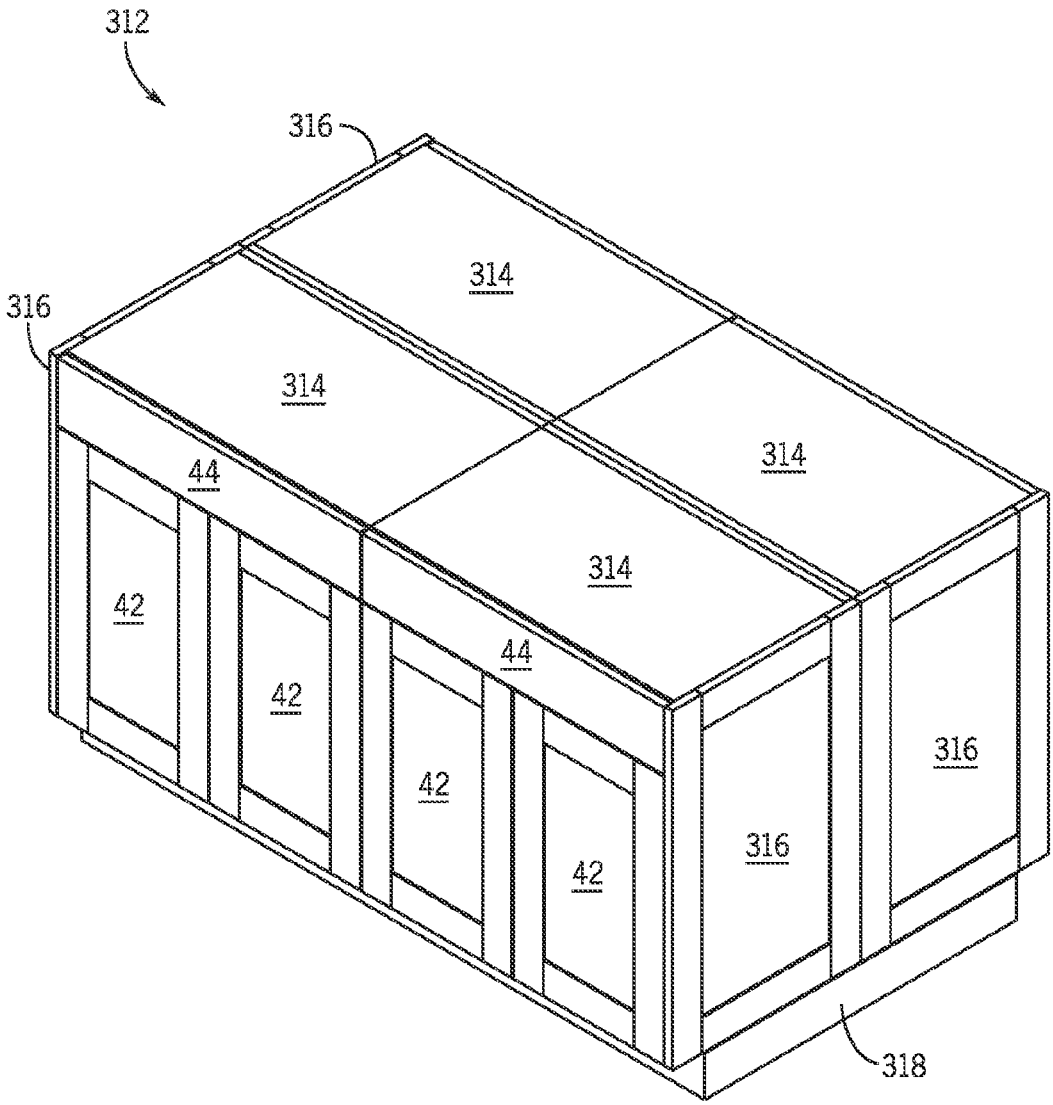
FIG. 29 is a perspective view of an island cabinet assembly useable with the cabinet assembly of FIG. 1.

Referring to FIG. 29, an island assembly 312 may be included within the cabinetry system 10 of FIG. 1, according to an embodiment of the invention. In the illustrated embodiment, island assembly 312 includes four base cabinets 314. Each base cabinet 314 includes an end panel 316 coupled to an outward-facing surface of its respective cabinet 314 in a similar manner as described with respect to end panel 48. End panels 316 may be manufactured to match the style of door panels 42, or with plain or flat surfaces similar to end panel 48. It is contemplated that base cabinets 314 may be manufactured in a similar manner as any of base cabinets 34-40 of FIG. 1. Further, one or more of base cabinets 314 may include a base cabinet storage compartment and removable end panels 316, similar to that described above with respect to base cabinet 38.

Figure 30:
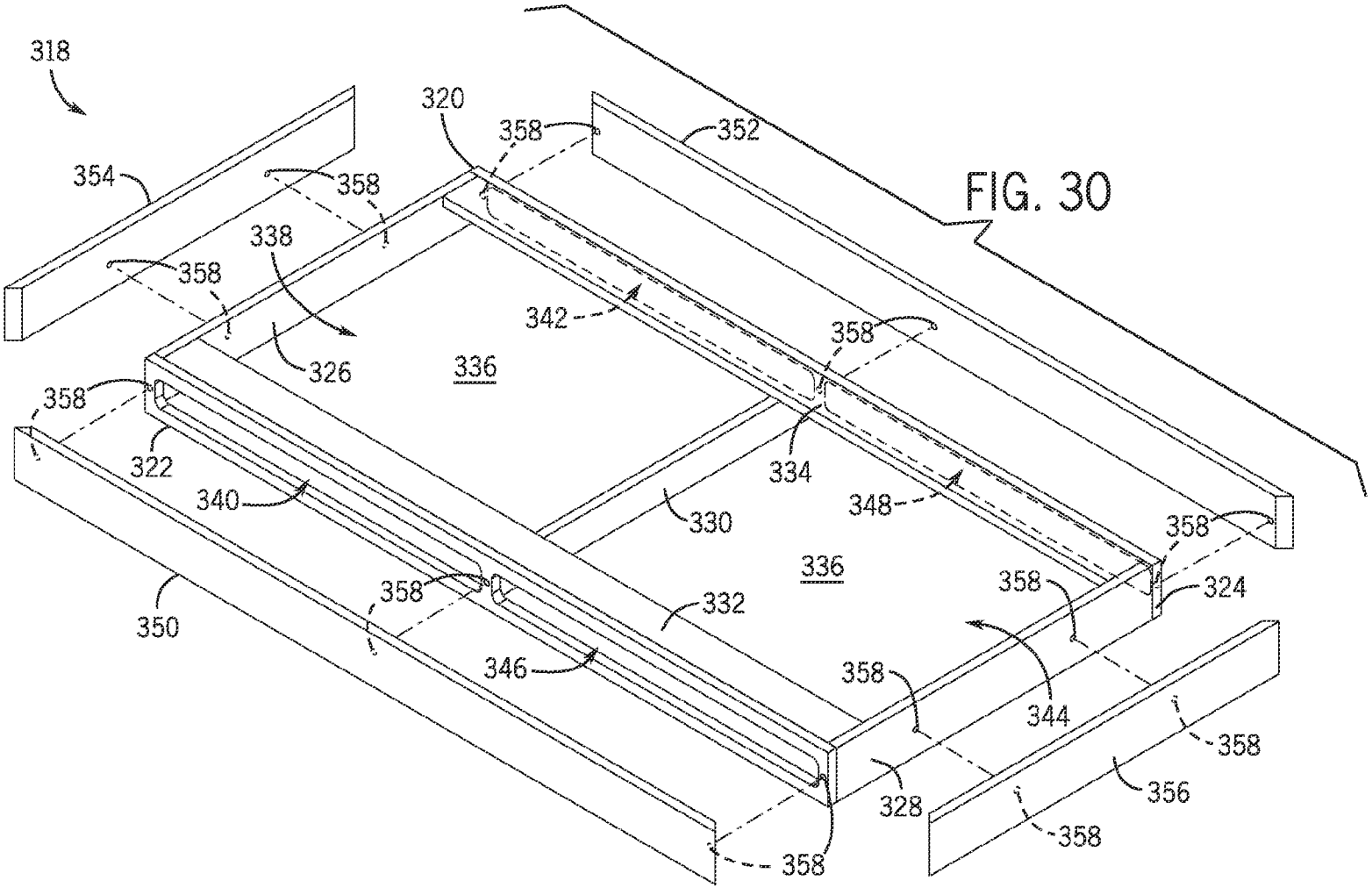
FIG. 30 is a perspective view of a toe kick assembly of the island cabinet assembly of FIG. 29.

Base cabinets 314 rest on an island toe kick assembly 318, which is illustrated in FIG. 30. Similar to toe kick assembly 54 (FIG. 28), island toe kick assembly 318 includes a storage frame 320 formed by a front panel 322 and rear panel 324 jointed together by two side panels 326, 328. A dividing panel 330 and a pair of top panels 332, 334 provide structural support for base cabinets 314. A base panel 336 is coupled to front, rear, and side panels 322-328. A first storage compartment 338 is accessible through an opening 340 in front panel 322 and an opening 342 in rear panel 324. Similarly, a second storage compartment 344 is accessible through openings 346, 348 formed in front and rear panels 322, 324, respectively.

Island toe kick assembly 318 also includes facie panels 350, 352, 354, 356, which couple to respective front, rear, and side panels 322-328 of storage frame 320 and to one another using magnets 358 in a similar manner as described with respect to toe kick assembly 54. Magnets 358 permit facie panels 350-356 to be interchanged without the use of tools.

Figure 31:
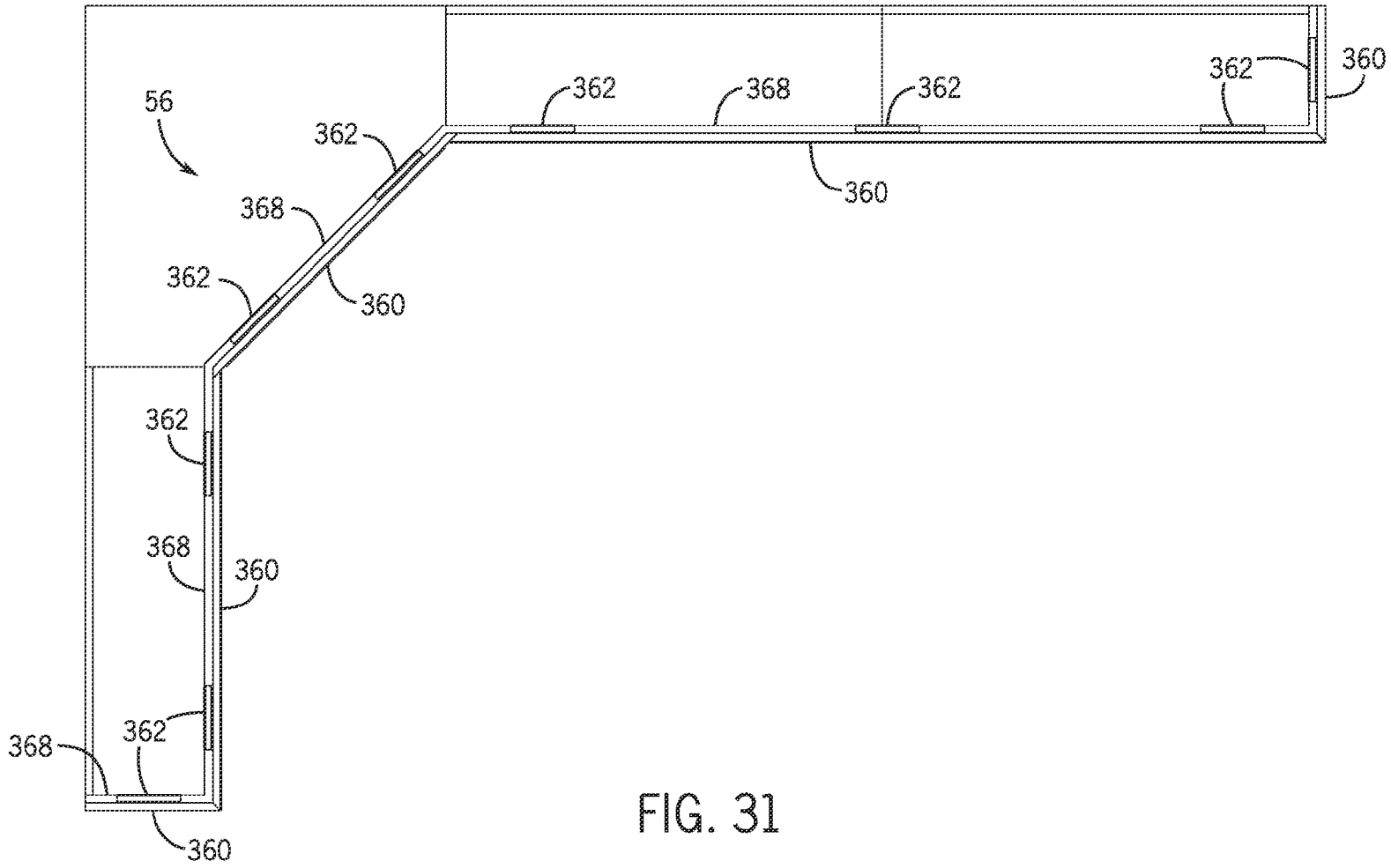
FIG. 31 is a top view of the upper cabinets of the cabinet assembly of FIG. 1, illustrating a crown molding assembly, which may be integrated within the cabinet assembly of FIG. 1 in one embodiment of the invention.
Figure 33:
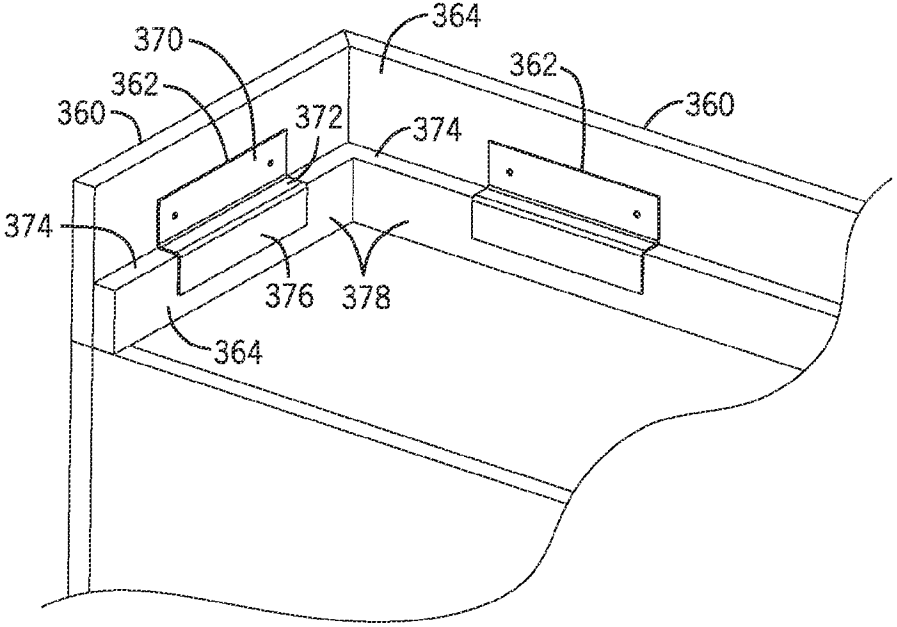
FIG. 33 is an assembled exploded perspective view showing a portion of the crown molding assembly of FIG. 31.
Figure 32:
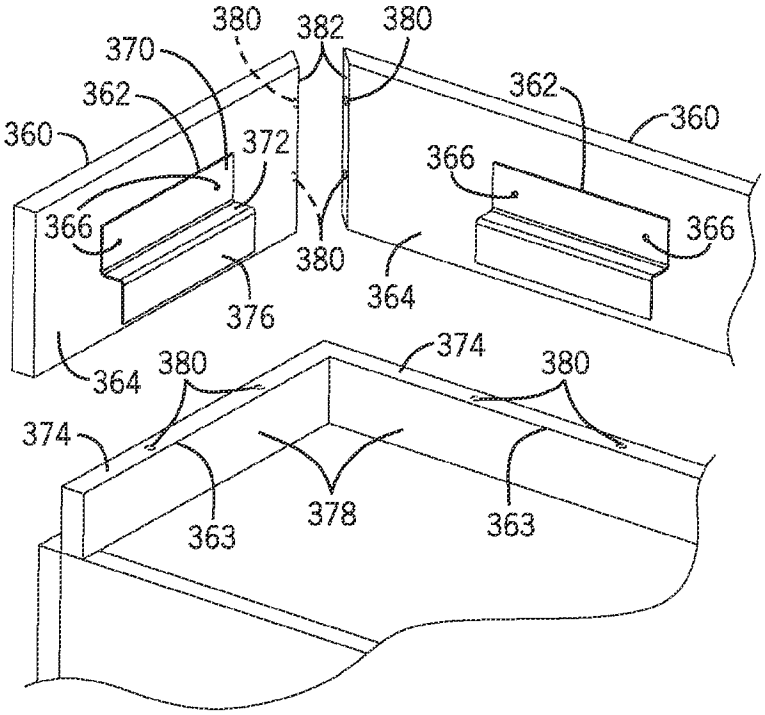
FIG. 32 is a partially exploded perspective view showing a portion of the crown molding assembly of FIG. 31.

Referring now to FIGS. 31-33, details of the crown molding assembly 56 of cabinetry system 10 are provided according to one embodiment of the invention. Similar to toe kick assembly 54 and island toe kick assembly 318, crown molding assembly 56 is likewise manufactured to facilitate removal and replacement of crown molding trim boards or panels 360 when it is desired to change to color or style of cabinetry system 10. In addition to trim panels 360, crown molding assembly 56 includes a plurality of mounting brackets 362 coupled to inside surfaces 364 of trim panels 360 with fasteners 366 and a mounting frame 368, which is coupled to upper cabinet assembly 12. In one embodiment, trim panels 360 may include threaded inserts (not shown) for receiving fasteners 366. These threaded inserts would permit mounting brackets to be moved between different sets of trim boards without fear of stripping the fastener openings in the trim boards.

As shown, each mounting bracket 362 includes a first vertical portion 370 that is coupled to trim panels 360, a horizontal portion 372 that rests on a top surface 374 of mounting frame 368, and a second horizontal portion 376 that rests against an inside surface 378 of mounting frame 368. As shown in FIG. 31, one or more mounting brackets 362 is spaced along the length of each trim panel 360. In one non-limiting embodiment, mounting brackets 362 are approximately 6 inches long and are positioned approximately every 16-24 inches along the length of a respective trim panel 360.

In one embodiment, mounting brackets 362 are manufactured from a magnetic material such as steel or other ferrous metal, which is magnetically attracted to optional magnets 380 (shown in phantom) that are recessed within the top surface 374 of mounting frame 368. In one embodiment two magnets 380 are provided for coupling to each mounting bracket 362, however, it is contemplated that more or less magnets may be used based on various design specifications such as the weight or profile of the trim panel 360, for example.

In an embodiment where magnets 380 are omitted, mounting brackets 362 may be manufactured from a non-ferrous material and mounting brackets 362 may be coupled to mounting frame 368 by a friction fit. In such an embodiment, an inner edge 363 of mounting frame 368 may be provided having a rounded edge to facilitate coupling trim panel 360 to mounting frame 368.

As shown, mounting brackets 362 retain trim panel 360 in position above mounting frame 368. Optionally, additional magnets 380 may be recessed within adjacent side surfaces 382 of trim panels 360 to assist in aligning adjacent trim panels 360 and maintaining a tight joint between adjacent trim panels 360.

Figure 34:
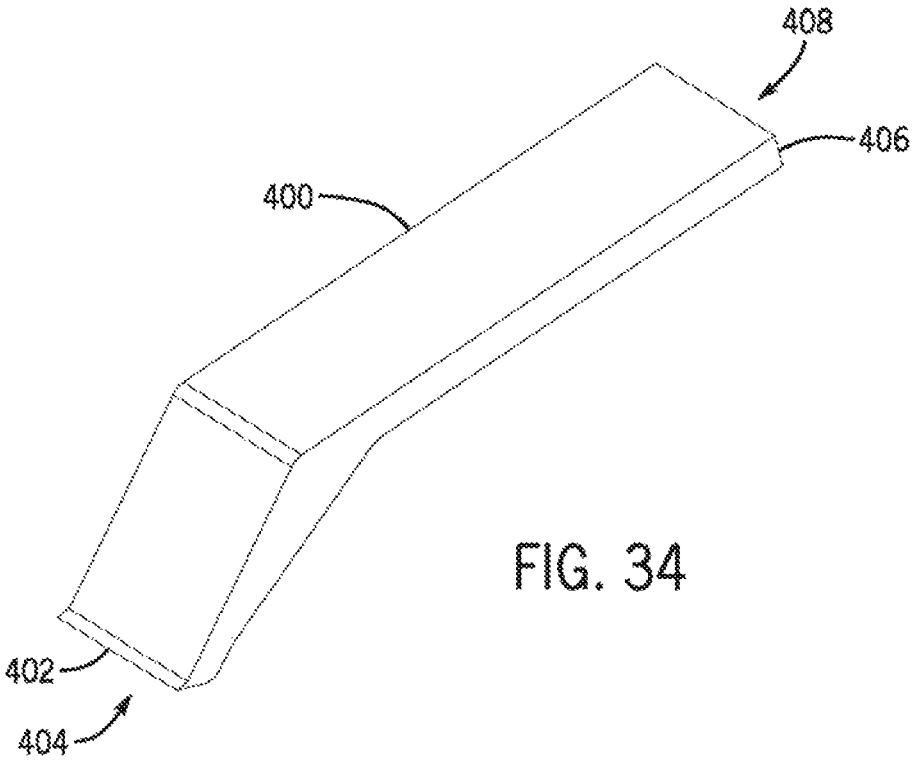
FIG. 34 is a perspective view of a removal tool useable with the cabinetry system of FIG. 1.

Referring now to FIG. 34, a removal tool 400 useable with cabinetry system 10 is illustrated according to one embodiment of the invention. Tool 400 includes a knife edge 402 located on a first end 404 of the tool 400 and a flat edge 406 located on a second end 408 of the tool 400. In one embodiment, first and second ends 404, 408 of tool 400 are sized such that either edge 402 or edge 406 of tool 400 may be inserted into slots 140, 142 of metal door plate 62. When knife edge 402 is inserted into slot 140, for example, a prying technique (similar to a technique used to remove a paint can lid) is used to separate metal door plate 62 from door panel 42. When flat edge 406 is inserted in to slot 140, a pushing technique is used to separate metal door plate 62 from door panel 42. Where metal door plate 62 includes two slots 140, 142, an operator may first insert tool 400 into a first slot 140 to separate the upper corner of door panel 42 from metal door plate 62 and next insert tool 400 into a second slot 142 to separate the lower corner of door panel 42.

In addition to aiding in the removal of door panels 42, tool 400 may be used to remove drawer panels 44 and the facie panels 298, 352 of toe kick assemblies 54, 318. In one embodiment, panels 298, 352 may be manufactured including a relish or back cut recess routed into the rear portion of the upper surface of one of the panels 298, 352. After removing an end panel 48, 316, knife edge 402 of tool 400 would be inserted into this recess and used to lever or pry the respective panel 298, 352 away from the structural frame. In alternative embodiments where panels 298, 352 do not include a recess, knife edge 402 is inserted at the interface between the structural frame 266, 320 of the toe kick assembly 54, 318 and the respective panel 298, 352.

As described above, cabinetry system 10 includes face panels that may be easily removed from the interior cabinet bodies and exchanged for different panels, permitting the entire outward appearance of the cabinetry system 10 to be changed in a short period of time. These face panels include removable drawer panels and door panels that are magnetically coupled to metal panels integrated within the cabinetry system, removable end panels that are magnetically coupled to respective cabinet boxes, and removable trim components, including toe kick facie panels and crown molding trim panels, as described above.

Therefore, according to one embodiment of the invention, a door assembly includes a door plate coupleable to at least one hinge assembly, the door plate having a first portion and a second portion extending outward from the first portion. The door assembly also includes a door panel having a recess formed in an inward-facing surface thereof, the recess sized to receive the door plate and a plurality of magnets inset within the inward-facing surface of the door panel adjacent the recess, the plurality of magnets magnetically coupled to the door plate.

According to another embodiment of the invention, a cabinet assembly includes a cabinet box comprising a pair of side panels and a door assembly. The door assembly includes a hinge assembly and a door plate coupled to a side panel of the pair of side panels via the hinge assembly, the door plate comprising a vertical portion and at least one horizontal portion extending outwardly from the vertical portion. The door assembly also includes a door panel having a recess formed in an inward-facing surface thereof and a first plurality of magnets positioned within recesses formed within the inward-facing surface of the door panel adjacent the recess. The first plurality of magnets are magnetically coupled to the door plate.

According to yet another embodiment of the invention, a door assembly includes at least one hinge, an L-shaped magnetic plate coupled to the at least one hinge via a mechanical fastener, and a door panel coupled to the L-shaped magnetic plate via a plurality of magnets, the door panel having an L-shaped recess sized to receive the L-shaped magnetic plate. A surface of the door panel and a surface of the L-shaped magnetic plate form an interior surface of the door assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cabinet assembly comprising:

a cabinet box comprising:

a bottom panel comprising a first end surface and a second end surface opposite the first end surface;

a top panel comprising a first end surface substantially aligned with the first end surface of the bottom panel and a second end surface substantially aligned with the second end surface of the bottom panel;

a first side panel extending between the bottom panel and the top panel adjacent to the first end surfaces of the bottom panel and the top panel; and a second side panel extending between the bottom panel and the top panel adjacent to the second end surfaces of the bottom panel and the top panel; and a first plurality of magnets positioned within recesses formed within at least one of the first end surface of the bottom panel, the first end surface of the top panel, an outer surface of the first side panel, and an outer surface of the second side panel;

an end panel having a second plurality of magnets recessed therein, the second plurality of magnets positioned to engage the first plurality of magnets;

a protrusion sized to fit within and aligned with an opening formed in one of the end panel and a surface of the cabinet box, the protrusion extending outward from the other of the end panel and the surface of the cabinet box, wherein the surface of the cabinet box comprises one of the first end surface of the bottom panel, the first end surface of the top panel, the outer surface of the first side panel, and the outer surface of the second side panel; and a door assembly coupled to at least one of the first side panel and the second side panel.

2. The cabinet assembly of claim 1 wherein the width of the end panel is at least equal to the width of one of the first side panel and the second side panel.

3. The cabinet assembly of claim 1 wherein the first and second pluralities of magnets comprise rare earth magnets.

4. The cabinet assembly of claim 1 further comprising:

a rear panel coupled to the bottom and top panels, the rear panel comprising a first end surface substantially aligned with the first end surfaces of the bottom and top panels; and a dividing panel substantially parallel to and spaced apart from the rear panel, the dividing panel extending from the first side panel toward the second side panel and coupled between the bottom and top panels;

wherein the first side panel extends from a front of the cabinet box to a rear surface of the dividing panel; and wherein a storage compartment is formed between the rear panel and the dividing panel.

5. The cabinet assembly of claim 4 wherein the storage compartment is further defined between an outward facing surface of the dividing panel, an inward facing surface of the rear panel, and an inward-facing surface of the second side panel.

6. The cabinet assembly of claim 4 further comprising a central panel substantially parallel to and positioned between the first and second side panels, the central panel extending between the rear panel and the front of the cabinet box;

wherein the dividing panel extends between the first side panel and the central panel; and wherein the storage compartment is further defined by the central panel.

7. A cabinet assembly comprising:

a cabinet box comprising:

a bottom panel;

a top panel substantially parallel to and aligned with the bottom panel; and a pair of side panels coupling the bottom panel and the top panel;

an end panel comprising an inward-facing surface having a first plurality of magnets recessed therein and magnetically coupled to a second plurality of magnets recessed within at least one of a first end surface of the bottom panel, a first end surface of the top panel, and an outer surface of a side panel of the pair of side panels;

at least one self-centering locating pin assembly comprising:

a pin body comprising:

a base portion recessed within the outer surface of the side panel; and a stem portion extending outwardly from the base portion; and a receiving body positioned within the inward-facing surface of the end panel and sized to receive the stem portion; and a door assembly coupled to the cabinet box.

8. The cabinet assembly of claim 7 further comprising a toe kick assembly comprising:

a toe kick storage frame positioned beneath the cabinet box, the toe kick storage frame comprising:

a front panel having at least one magnet recessed therein;

a rear panel;

a pair of side panels coupling the front panel to the rear panel; and a bottom panel extending between the pair of side panels and between the front panel and the rear panel; and a facie panel comprising at least one magnet positioned to magnetically couple with the at least one magnet of the front panel;

wherein a toe kick storage compartment is formed between the pair of side panels, the toe kick storage compartment accessible through an opening formed in the front panel when the facie panel is decoupled therefrom.

9. The cabinet assembly of claim 7 further comprising a drawer assembly comprising:

a drawer box sized to fit within a drawer opening in the cabinet box;

a magnetic drawer plate coupled to a front panel of the drawer box; and a drawer panel comprising a cavity sized to receive the magnetic drawer plate and having a plurality of magnets recessed therein that magnetically couple the drawer panel to the magnetic drawer plate.

10. The cabinet assembly of claim 9 wherein the door assembly and the drawer panel have a full overlay construction.

11. The cabinet assembly of claim 7 wherein the door assembly comprises:

a hinge assembly coupled to one the pair of side panels;

a door plate coupled to the hinge assembly, the door plate comprising a magnetic material;

a door panel comprising a rear surface having a cavity formed therein, the cavity sized to receive the door plate; and a plurality of magnets recessed within the cavity of the door panel and magnetically coupling the door plate to the door panel.

12. The cabinet assembly of claim 7 further comprising a crown molding assembly comprising:

a molding trim panel;

a mounting bracket coupled to an inside surface of the molding trim panel, the mounting bracket comprising:

a first vertical portion coupled to the molding trim panel;

a horizontal portion positioned on a top surface of a mounting frame of the cabinet box; and a second vertical portion positioned against an inside surface of the mounting frame;

wherein the mounting bracket couples the molding trim panel to the mounting frame.

13. The cabinet assembly of claim 12 wherein the mounting bracket comprises a magnetic material; and wherein at least one magnet is recessed in a top surface of the mounting frame and magnetically couples the mounting bracket to the mounting frame.

14. A cabinetry system comprising:

a plurality of cabinet boxes comprising at least a first cabinet box and a last cabinet box, each cabinet box of the plurality of cabinet boxes comprising:

a bottom panel comprising a first end surface and a second end surface;

a top panel comprising a first end surface and a second end surface;

a first side panel coupling the bottom panel and the top panel at the first end surfaces of the bottom and top panels; and a second side panel coupling the bottom panel and the top panel at the second end surfaces of the bottom and top panels, wherein, with the exception of the first side panel of the first cabinet box and the second side panel of the last cabinet box, the first side panel of each cabinet box is adjacent to the second side panel of another cabinet box and the second side panel of each cabinet box is adjacent to the first side panel of another cabinet box; and at least one magnet recessed within at least one of the bottom panel, the top panel, the first side panel, and the second side panel;

a first interchangeable end panel comprising a plurality of magnets recessed therein and magnetically coupled to the at least one magnet of the first cabinet box; and a first self-centering locating pin assembly for retaining the first interchangeable end panel on the first cabinet box.

15. The cabinetry system of claim 14 further comprising:

a second interchangeable end panel comprising a plurality of magnets recessed therein and magnetically coupled to the at least one magnet of the last cabinet box; and a second self-centering locating pin assembly for retaining the second interchangeable end panel on the last cabinet box.

16. The cabinetry system of claim 14 wherein the first locating pin assembly comprises:

a first pin body comprising:

a first base portion recessed within the first side panel of the first cabinet box; and a first stem portion extending outwardly from the base portion; and a first receiving body formed in the first interchangeable end panel and sized to receive the first stem portion.

17. The cabinetry system of claim 14 wherein the plurality of cabinet boxes are arranged in one of an L-shaped, U-shaped, galley, or single wall configuration.

18. The cabinetry system of claim 14 further comprising a toe kick assembly comprising:

a toe kick storage frame positioned underneath the plurality of cabinet boxes, the toe kick storage frame comprising:

a front panel comprising an opening for each cabinet box thereabove and at least one magnet recessed therein;

a rear panel;

a pair of side panels coupling the front panel and the rear panel;

a bottom panel coupled to the front panel, the rear panel, and the pair of side panels; and at least one support panel positioned between the pair of side panels, each support panel coupling the front panel to the rear panel;

wherein a toe kick storage compartment is formed underneath each cabinet box between the front panel, the rear panel, a support panel of the at least one support panel, and one of a side panel of the pair of side panels and another support panel of the at least one support panel; and a facie panel magnetically coupled to the front panel.

19. The cabinetry system of claim 14 further comprising a molding assembly comprising:

a molding trim panel;

a mounting bracket coupled to an inside surface of the molding trim panel, the mounting bracket comprising:

a first portion coupled to the molding trim panel;

a second portion oreiented parallel to the first portion; and a third portion oriented perpendicular to the first and second portions and positioned therebetween;

wherein the third portion of the mounting bracket rests on a top surface of at least one cabinet box of the plurality of cabinet boxes; and wherein the third portion of the mounting bracket is magnetically coupled to at least one cabinet box of the plurality of cabinet boxes.

20. The cabinetry system of claim 14 wherein the first cabinet box further comprises a storage compartment defined by:

a top surface of the bottom panel;

a bottom surface of the top panel;

an inward-facing surface of a rear panel of the first cabinet box, the rear panel coupled to rear surfaces of the bottom panel, the top panel, and the second side panel;

an inward-facing surface of the second side panel; and a rear surface of a dividing panel of the first cabinet box, the dividing panel coupled to the inward-facing surface of the second side panel and an inward-facing surface of the first side panel at a rear surface of the first side panel;

wherein the storage compartment is positioned behind the first end panel.

* * * * *